US009828131B2

(12) United States Patent
James et al.

(10) Patent No.: US 9,828,131 B2
(45) Date of Patent: Nov. 28, 2017

(54) SHIPPING AND DISPLAY TRAY AND BLANK FOR FORMING THE SAME

(71) Applicant: WestRock Shared Services, LLC, Norcross, GA (US)

(72) Inventors: Jeffrey Scott James, Elmhurst, IL (US); Matthew Kiev Swenson, Wood Dale, IL (US)

(73) Assignee: WestRock Shared Services, LLC, Norcross, GA (US)

( * ) Notice: Subject to any disclaimer, the term of this patent is extended or adjusted under 35 U.S.C. 154(b) by 1 day.

(21) Appl. No.: 14/877,579

(22) Filed: Oct. 7, 2015

(65) Prior Publication Data

US 2016/0023798 A1 Jan. 28, 2016

Related U.S. Application Data

(63) Continuation of application No. 13/731,345, filed on Dec. 31, 2012, now Pat. No. 9,162,792.

(60) Provisional application No. 61/582,765, filed on Jan. 3, 2012.

(51) Int. Cl.

| | |
|---|---|
| ***B65D 5/50*** | (2006.01) |
| ***B65D 5/52*** | (2006.01) |
| ***B65D 5/20*** | (2006.01) |
| ***B65D 5/42*** | (2006.01) |

(52) U.S. Cl.

CPC ..... *B65D 5/5286* (2013.01); *B65D 5/20* (2013.01); *B65D 5/4266* (2013.01); *B65D 5/504* (2013.01); *B65D 5/5019* (2013.01); *B65D 5/5021* (2013.01)

(58) Field of Classification Search

CPC ..... B65D 5/5286; B65D 5/20; B65D 5/4266; B65D 5/5021

USPC ..... 229/120.15, 235, 242, 164, 173, 241; 206/485, 564, 736, 756

See application file for complete search history.

(56) References Cited

U.S. PATENT DOCUMENTS

| | | | |
|---|---|---|---|
| 895,218 | A | 8/1908 | Weston |
| 1,515,638 | A | 11/1924 | Wason |
| 2,256,995 | A | 9/1941 | Andres |
| 2,431,535 | A | 11/1947 | Bergstrom |
| 3,009,622 | A | 11/1961 | Leone |
| 3,077,294 | A | 2/1963 | Barrez |
| 3,314,530 | A | 4/1967 | Michalka |
| 3,351,182 | A | 11/1967 | Greer et al. |
| 3,393,076 | A | 7/1968 | Moyer et al. |

(Continued)

FOREIGN PATENT DOCUMENTS

DE 3940872 C2 6/1993

OTHER PUBLICATIONS

PCT Search Report and Written Opinion dated Mar. 8, 2013 for PCT/US2012/072293 (15 Pages).

*Primary Examiner* — Christopher Demeree
(74) *Attorney, Agent, or Firm* — WestRock IP Legal

(57) ABSTRACT

A blank for forming a tray for shipping and displaying at least one product is provided. The blank includes a bottom panel, a pair of opposed side panels connected to the bottom panel, and at least one divider panel assembly connected to the bottom panel and one of the side panels. The at least one divider panel assembly includes a plurality of support slots configured to receive a portion of at least one of the containers to secure the container to the tray, to display the containers within the tray, and to enable individual access to each of the containers within the tray.

22 Claims, 21 Drawing Sheets

(56) References Cited

U.S. PATENT DOCUMENTS 3,623,601 A 11/1971 Okutani
3,664,494 A 5/1972 Mergens
3,696,940 A 10/1972 Hoffman et al.
3,756,385 A 9/1973 Steinbock
3,812,957 A 5/1974 Forbes, Jr.
3,927,761 A 12/1975 Boyle
3,990,624 A 11/1976 Melli
4,313,547 A 2/1982 Osborne
4,450,965 A 5/1984 Paillet
4,485,922 A 12/1984 Desmond et al.
4,582,194 A 4/1986 Karpiloff et al.
4,832,199 A 5/1989 Rigby
4,905,889 A 3/1990 Schuster
5,121,838 A 6/1992 Dickie
5,402,930 A * 4/1995 Storms ..... B65D 5/3678 229/114
5,497,882 A 3/1996 Kenyon
5,505,309 A 4/1996 Taravella et al.
5,529,187 A 6/1996 DeNola
5,588,583 A 12/1996 Cargile, Jr.
5,913,426 A 6/1999 Lotz Renfro et al.
5,979,662 A 11/1999 Green
5,996,804 A 12/1999 Kuhn et al.
6,050,420 A 4/2000 Green
6,152,305 A 11/2000 Green
6,279,757 B1 8/2001 Hayoun
6,367,632 B1 4/2002 Green
6,427,842 B1 8/2002 Green
6,431,363 B1 * 8/2002 Hacker ..... B65D 5/5038 206/486
6,435,351 B1 * 8/2002 Gibb ..... B65D 5/542 206/736
6,510,982 B2 * 1/2003 White ..... A47F 5/112 206/736
6,953,118 B2 10/2005 Seno et al.
7,410,062 B2 8/2008 Monk
7,624,876 B1 12/2009 Green
7,735,649 B2 6/2010 Kim-Gifford et al.
7,959,007 B1 6/2011 Ballentine et al.
8,028,839 B2 10/2011 Learn
2002/0017477 A1 2/2002 Azam et al.
2002/0088736 A1 7/2002 Liu
2007/0125678 A1 6/2007 Green
2012/0273383 A1 11/2012 Bahr

* cited by examiner

SHIPPING AND DISPLAY TRAY AND BLANK FOR FORMING THE SAME

CROSS REFERENCE TO RELATED APPLICATIONS

This application is a continuation of U.S. patent application Ser. No. 13/731,345, filed Dec. 31, 2012, which claims priority to U.S. Provisional Application No. 61/582,765 filed Jan. 3, 2012, the entire contents of which are hereby incorporated by reference in their entirety.

BACKGROUND OF THE INVENTION

The field of the invention relates generally to a tray formed from a blank of sheet material and, more particularly, to a tray for supporting a plurality of containers during shipment of the containers and for displaying the containers at a point of sale It is a known practice to employ trays and cartons to store and transport sales articles from the manufacturer to the place of sale, such as a retail store. Typically, these cartons are formed from at least one blank made of corrugated paperboard which is suitably cut, scored and folded to produce a generally rectangular shaped box. Once the carton reaches the place of sale, the articles are unpackaged from the carton and are typically placed on display shelves. One drawback of such cartons is that a significant amount of labor is required to remove the articles from the container and, in turn, place them on the display shelves.

It is known that some cartons can be utilized to ship the sales articles and are convertible into a display device at the place of sale, thereby eliminating the labor required in transferring the articles from the carton to the shelves of the place of sale. However, these convertible cartons do not typically hold the sales articles in place during shipment, and do not easily display the articles at the point of sale.

At least some known trays are configured to hold a plurality of containers therein. Most of these known trays are formed from a relatively large blank having a plurality of panels that fold and/or wrap to define container holders. More specifically, the plurality of panels form a rectangular tube having cutouts into which the containers are inserted. Because these trays are formed from a relatively large blank of sheet material they can be expensive to make. Moreover, because of the plurality of panels, they can be complicated to form.

Accordingly, it desirable to provide a tray that can be used to hold a plurality of containers during shipment, and can be easily converted into a display tray that can be placed on shelves for displaying said plurality of containers at a point of sale.

BRIEF DESCRIPTION OF THE INVENTION

In one aspect, a blank for forming a tray for shipping and displaying at least one product is provided. The blank includes a bottom panel, a pair of opposed side panels connected to the bottom panel, and at least one divider panel assembly connected to the bottom panel and one of the side panels. The at least one divider panel assembly includes a plurality of support slots configured to receive a portion of at least one of the containers to secure the container to the tray, to display the containers within the tray, and to enable individual access to each of the containers within the tray.

In another aspect, a tray formed from a blank of sheet material is provides. The tray is for shipping and displaying at least one product. The tray includes a bottom wall, a pair of opposed side walls connected to the bottom wall, and at least one divider panel assembly connected to the bottom wall and one of the side walls. The at least one divider panel assembly includes a plurality of support slots configured to receive a portion of at least one of the containers to secure the container to the tray, to display the containers within the tray, and to enable individual access to each of the containers within the tray.

In another aspect, a blank for forming a tray for shipping and displaying at least one product is provided. The blank includes a bottom panel, a pair of opposed end panels connected to the bottom panel, and at least one divider panel connected to one of the end panels. The at least one divider panel includes a plurality of support slots configured to receive a portion of at least one of the containers to secure the container to the tray, to display the containers within the tray, and to enable individual access to each of the containers within the tray.

In another aspect, a tray formed from a blank of sheet material is provided. The tray is for shipping and displaying at least one product. The tray including a bottom wall, a pair of opposed end walls connected to the bottom wall, and at least one divider panel wall connected to one of the end walls. The at least one divider panel wall includes a plurality of support slots configured to receive a portion of at least one of the containers to secure the container to the tray, to display the containers within the tray, and to enable individual access to each of the containers within the tray.

DETAILED DESCRIPTION OF THE INVENTION

Figure 1:
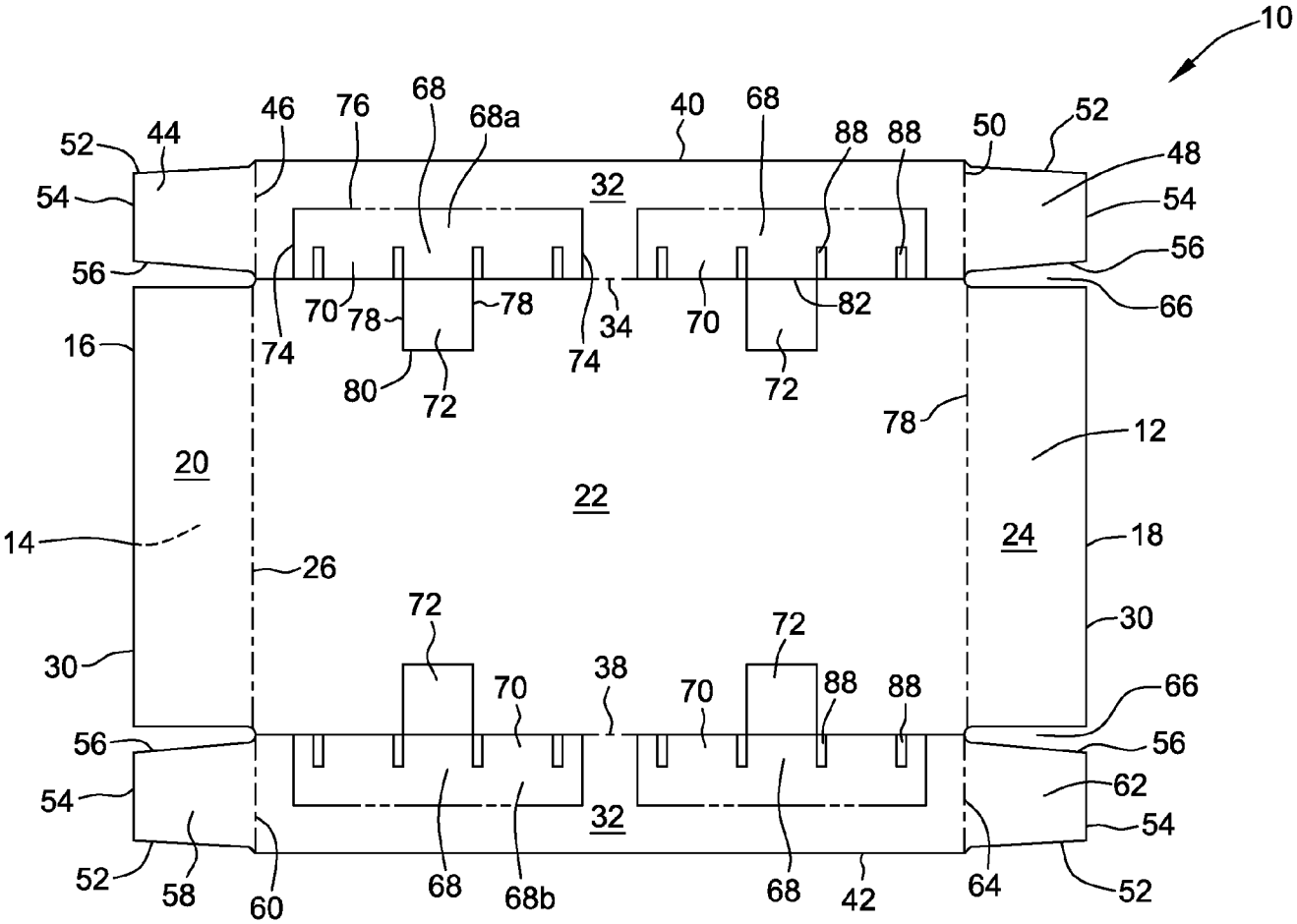
FIG. 1 is top plan view of a blank of sheet material for forming an exemplary embodiment of a tray described herein.

The embodiments described herein provide a shipping tray configured to support and/or contain a plurality of containers and/or products. For example, the trays described herein can be used to contain a plurality of cylindrical and/or tub-shaped containers having a rim member, such as dog or cat food containers, during transport to a store, during storage of the containers and/or during display of the containers at the store.

More specifically, the trays described herein are formed from a blank of sheet material. The trays are designed to ship and display a plurality of containers or other articles contained therein. The trays include a bottom panel, a rear-side panel coupled to the bottom panel, and two opposing divider panel assemblies coupled to the bottom panel. The two opposing divider panel assemblies include a plurality of support slots configured to receive a rim member of at least one of the containers for securing to the tray the container being shipped and for displaying a display face of the containers to potential customers. The display face being the face of the container intended to be displayed to potential customers.

The trays described herein can be shipped as flat blanks to a manufacturer and formed into trays by the manufacturer as part of the production line of the manufacturer. The manufacturer can then place their products housed within containers into the formed trays for shipment and display within a store. Alternatively, the trays can be formed prior to shipment to the manufacturer so that the manufacturer merely has to insert their product containers into the already formed trays for shipment and display at the store. This alternative approach allows the manufacturer to forego having a tray forming machine at its production facility since the trays are provided to the manufacturer in a preformed condition.

It is known that products or articles for sale oftentimes come within a container. Such containers include markings or graphics on the outside of the containers. These markings or graphics are used to advertise the product or articles contained within the containers. Thus, it is important for the markings or graphics printed on the outside of the containers to be clearly displayed to potential customers when these products are placed on shelves within stores. The idea being that the more visible the advertising graphics are to a potential consumer on a shelf at a store, the more likely the consumer will purchase the product. The shape of the container that the product comes in can be an important factor when determining how to display the product. For example, in some cases, one particular side of the container may be smaller than other sides of the container. This smaller side is sometimes referred to as the display face of the container because it is the side that should be displayed to consumers to increase the face visibility of the product. However, in some cases it may be difficult to display the display face of a container. For example, if the display face is the top or lid of a container, it may be difficult to display the display face of the container on a shelf within a store.

The trays described herein are configured to hold the containers being shipped within the trays in an upright position to: (i) secure the containers within the trays, (ii) prevent movement of the containers during shipment, (iii) maximize the number of containers being shipped within the trays, (iv) display the display face of the containers when the tray is placed on a shelf at a point of sale so that the display face is clearly visible to potential customers, and (v) make each container individually accessible by a customer when the tray of containers is placed on a shelf at a point of sale. By making the containers individually accessible, a consumer can easily see different products (i.e., different flavors, etc.) stored within the containers and can easily retrieve one or more of the containers without having to search and move other containers that may be blocking the view of the consumer.

The trays described herein can be used to ship and display containers having rim members or blister packages or any other container/package requiring support for displaying its display face and providing individual accessibility.

The following detailed description illustrates the disclosure by way of example and not by way of limitation. The description clearly enables one skilled in the art to make and use the disclosure, describes several embodiments, adaptations, variations, alternatives, and use of the disclosure, including what is presently believed to be the best mode of carrying out the disclosure.

Various embodiments of shipping trays formed from a single sheet of material and a method and machine for constructing the trays are described herein. The trays may be constructed from a blank of sheet material using a machine. In one embodiment, the trays are fabricated from a cardboard material. The trays, however, may be fabricated using any suitable material, and therefore are not limited to a specific type of material. In alternative embodiments, the trays are fabricated using cardboard, plastic, fiberboard, paperboard, foamboard, corrugated paper, and/or any suitable material known to those skilled in the art and guided by the teachings herein provided.

In an example embodiment, the tray includes at least one marking thereon including, without limitation, indicia that communicates the product stored in the tray, a manufacturer of the product and/or a seller of the product. For example, the marking may include printed text that indicates a product's name and briefly describes the product, logos and/or trademarks that indicate a manufacturer and/or seller of the product, and/or designs and/or ornamentation that attract attention. "Printing," "printed," and/or any other form of "print" as used herein may include, but is not limited to including, ink jet printing, laser printing, screen printing, giclée, pen and ink, painting, offset lithography, flexography, relief print, rotogravure, dye transfer, and/or any suitable printing technique known to those skilled in the art and guided by the teachings herein provided. In another embodiment, the tray is void of markings, such as, without limitation, indicia that communicates the product, a manufacturer of the product and/or a seller of the product.

Figure 2:
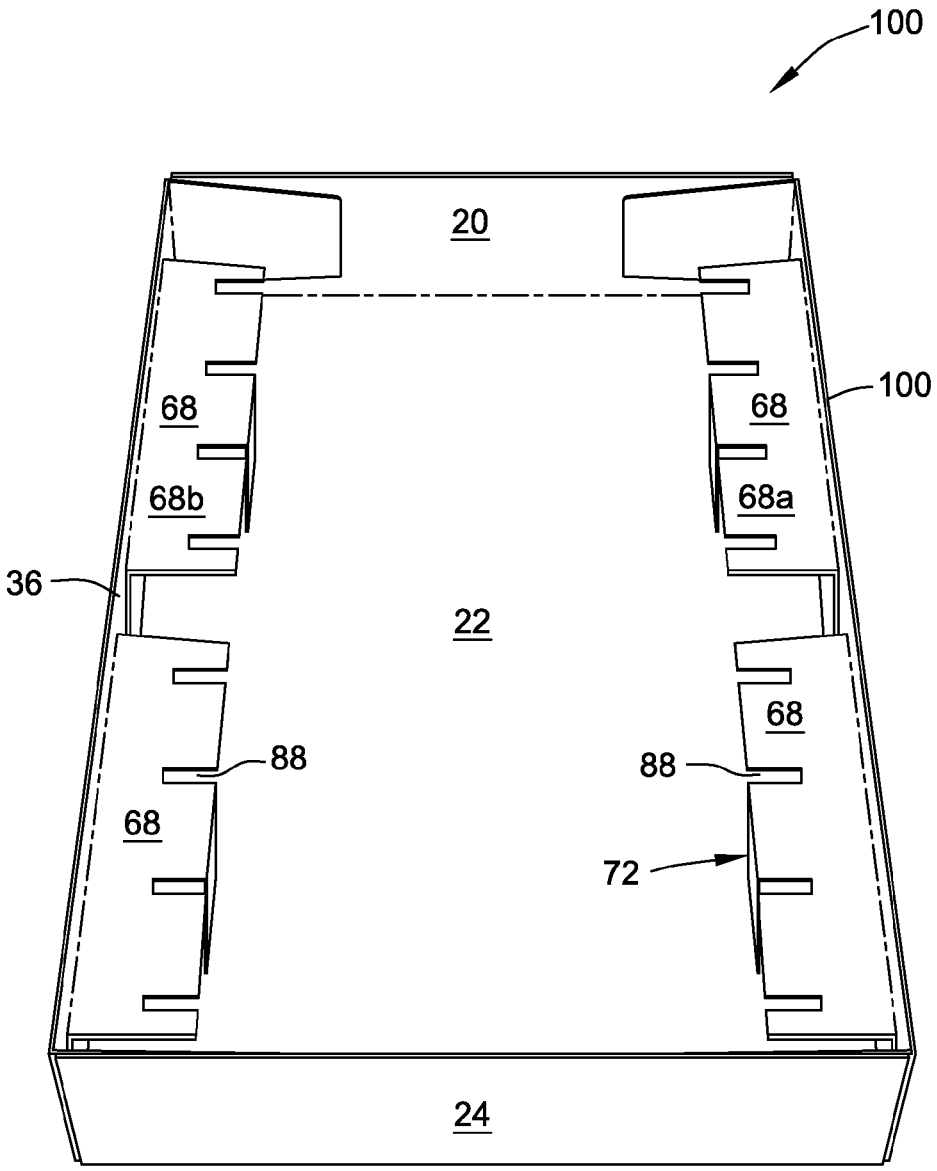
FIG. 2 is a perspective view of a tray formed from the blank shown in FIG. 1.
Figure 3:
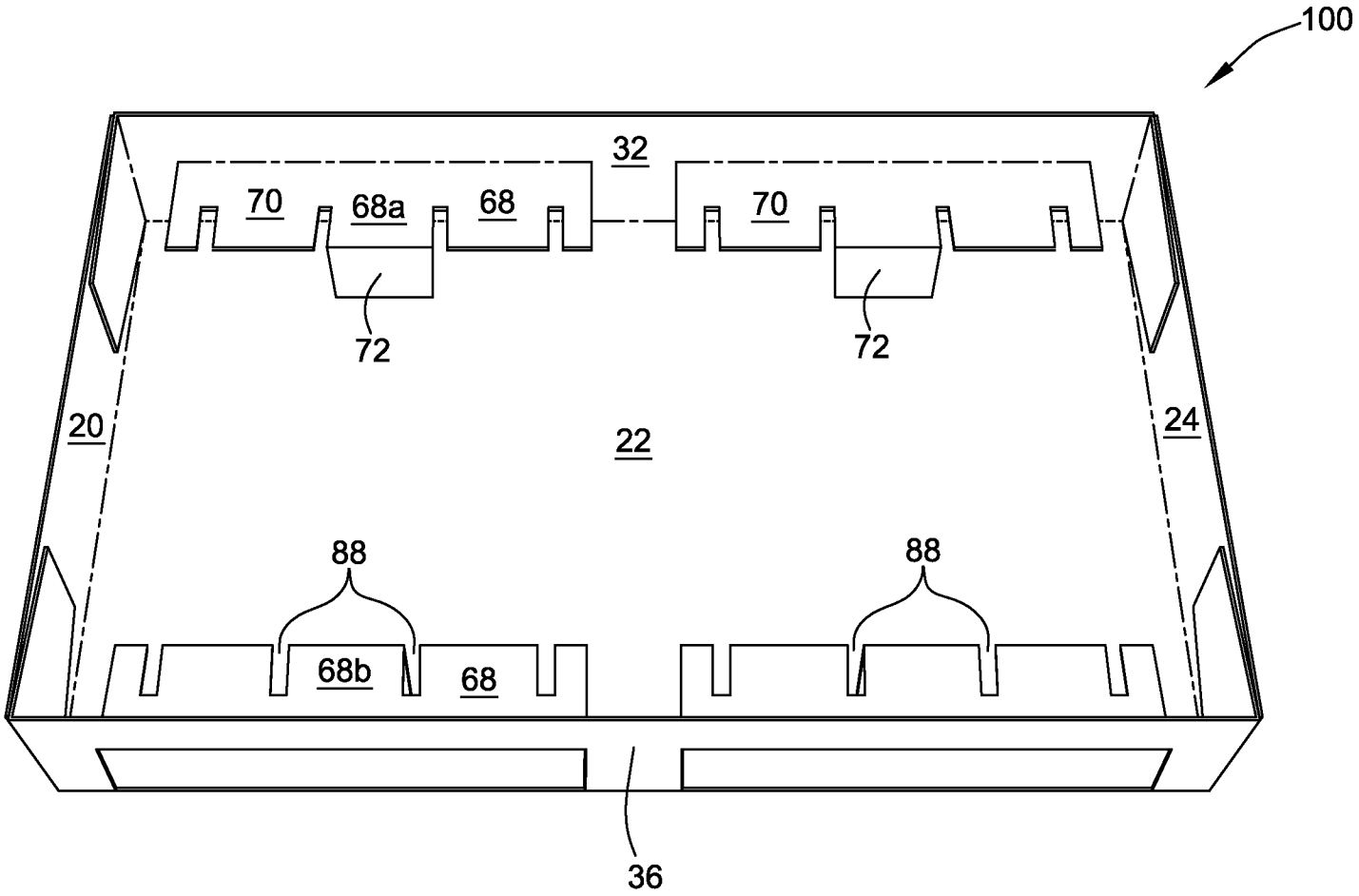
FIG. 3 is another perspective view of the tray shown in FIG. 2.

Referring now to the drawings, FIG. 1 is a top view of an exemplary blank 10 of sheet material for forming a tray, such as a tray 100 (shown in FIGS. 2 and 3). Blank 10 has a first or interior surface 12 and an opposing second or exterior surface 14. Further, blank 10 defines a first edge 16 and an opposing second edge 18. In one embodiment, blank 10 includes, in series from first edge 16 to second edge 18, a first end panel 20, a bottom panel 22, and a second end panel 24 coupled together along preformed, generally parallel, fold lines 26 and 28, respectively. More specifically, first end panel 20 extends from first edge 16 to fold line 26, bottom panel 22 extends from first end panel 20 along fold line 26, second end panel 24 extends from bottom panel 22 along fold line 28 to second edge 18. Fold lines 26 and/or 28, as well as other fold lines and/or hinge lines described herein, may include any suitable line of weakening and/or line of separation known to those skilled in the art and guided by the teachings herein provided. In the exemplary embodiment, each end panel 20 and 24 includes free side edges 30. When tray 100 is formed from blank 10, fold line 26 defines a bottom edge of first end panel 20 and a first end edge of bottom panel 22; fold line 28 defines a second end edge of bottom panel 22 and a bottom edge of second end panel 24; first edge 16 defines a top edge of first end panel 20; and second edge 18 defines a top edge of second end panel 24.

A first side panel 32 extends from a first side edge of bottom panel 22 at a fold line 34, and a second side panel 36 extends from a second side edge of bottom panel 22 at a fold line 38. Fold lines 34 and 38 are substantially parallel. First side panel 32 has a free edge 40 that defines a top edge of first side panel 32 when tray 100 is formed, and second side panel 36 has a free edge 42 that defines a top edge of second side panel 36 when tray 100 is formed. A first end flap 44 extends from an end edge of first side panel 32 at a fold line 46, and a second end flap 48 extends from an opposing end edge of first side panel 32 at a fold line 50. Each end flap 44 and 48 includes free edges 52, 54, and 56. Similarly, a third end flap 58 extends from an end edge of second side panel 36 at a fold line 60, and a fourth end flap 62 extends from an opposing end edge of second side panel 36 at a fold line 64. Each end flap 58 and 62 includes free edges 52, 54, and 56. In the exemplary embodiment, each end flap 44, 48, 58, and 62 is separated from an adjacent end panel 20 or 24 by a gap 66; however, it should be understood that any of end flaps 44, 48, 58, and/or 62 can be separated from an adjacent end panel 20 or 24 by a cut line without gap 66.

Each end panel 20 and 24 has a height H1, and each side panel 32 and 36 has a height H2. In the exemplary embodiment, height H1 is substantially equal to height H2. Alternatively, height H1 is other than substantially equal to height H2, for example less than or greater than height H2. In the exemplary embodiment, end flaps 44, 48, 58, and 62 each have a height H3 that is approximately equal to, or slight smaller than height H1. Further, end panels 20 and 24 each have a width W1, and side panels 32 and 36 each have a width W2 that is larger than width W1. Alternatively, width W2 is equal to or less than width W1 depending on what type and/or how many products tray 100 supports therein.

Blank 10 further includes a plurality of divider panel assemblies 68. In the exemplary embodiment, blank 10 includes a first divider panel assembly 68*a* defined within side panel 32 and a second divider panel assembly 68*b* defined within side panel 36. However, divider panel assemblies 68*a* and 68*b* could also be defined within end panels 20 and 24. Each divider panel assembly 68*a* and 68*b* is configured similarly and is referred to generically as divider panel assembly 68 for the sake of simplicity. In the exemplary embodiment, each side panel 32 and 36 includes two divider panel assemblies 68. Alternatively, each side panel 32 and 36 could include one divider panel assembly 68 or more than two divider panel assemblies. In the exemplary embodiment, divider panel assemblies 68 have any suitable size and/or configuration based on the containers supported by tray 100. Further, divider panel assemblies 68 are configured to cooperate with an adjacent divider panel assembly 68 to secure the containers within tray 100. For example, each of the containers is contacted by two divider panel assemblies 68.

In the exemplary embodiment, each divider panel assembly 68 includes an upper panel 70 defined within panels 32 and/or 36 and an inner panel 72 defined within bottom panel 22. More specifically, upper panel 70 is defined within panels 32 and/or 36 by side cut lines 74 and a fold line 76. Inner panel 72 is defined within bottom panel 22 by side cut lines 78 and a fold line 80. Upper panel 70 and inner panel 72 are connected to each other at a fold line 82 that is substantially collinear with a respective fold line 34 or 38. Alternatively, fold line 82 is offset from a respective fold line 34 or 38.

In the exemplary embodiment, each upper panel 70 of divider panel assembly 68 includes a plurality of support slots 88. Support slots 88 are configured to engage the rim member of the containers being shipped within tray 100 when tray 100 is erected. More specifically, when tray 100 is erected, divider panel assemblies 68 are "popped-up" such that each upper panel 70 is substantially parallel with bottom panel 22, and each inner panel 72 is substantially perpendicular to bottom panel 22. The containers being shipped within tray 100 are then placed within tray 100 such that the rim member of each container being shipped is inserted within support slots 88. Accordingly, each shipped container is supported within tray 100 during shipment and display. This support helps prevent movement of the containers within tray 100 during shipment, and also facilitates improved display of the container products within tray 100 when being sold within the store.

In one embodiment, a single divider panel assembly 68, such as divider panel assembly 68*a*, is used to support several containers being shipped within tray 100. In another embodiment, two divider panel assemblies 68 positioned across from one another, such as divider panel assemblies 68*a* and 68*b*, are used in combination to support several containers being shipped within tray 100.

When erected, tray 100 is configured to hold the containers (e.g., containers or blister packages) being shipped within tray 100 in an upright position to: (i) secure the containers within tray 100, (ii) prevent movement of the containers during shipment, (iii) maximize the number of containers being shipped within tray 100, (iv) display the display face of the containers when tray 100 is placed on a shelf at a point of sale so that the display face is clearly visible to potential customers, and (v) make each container individually accessible by a customer when tray 100 is placed on a shelf at a point of sale. By making the containers individually accessible, a consumer can easily see different products (i.e., different flavors, etc.) stored within the containers and can easily retrieve one or more of the containers without having to search and move other containers that may be blocking the view of the consumer.

FIG. 2 is a perspective view of blank 10 (shown in FIG. 1) in an erected position for forming tray 100. FIG. 3 is an alternative perspective view of blank 10 for forming tray 100. Elements of blank 10 shown in FIGS. 2 and 3 that are identical to elements shown in FIG. 1 are shown using the same numeric character references.

Figure 4:
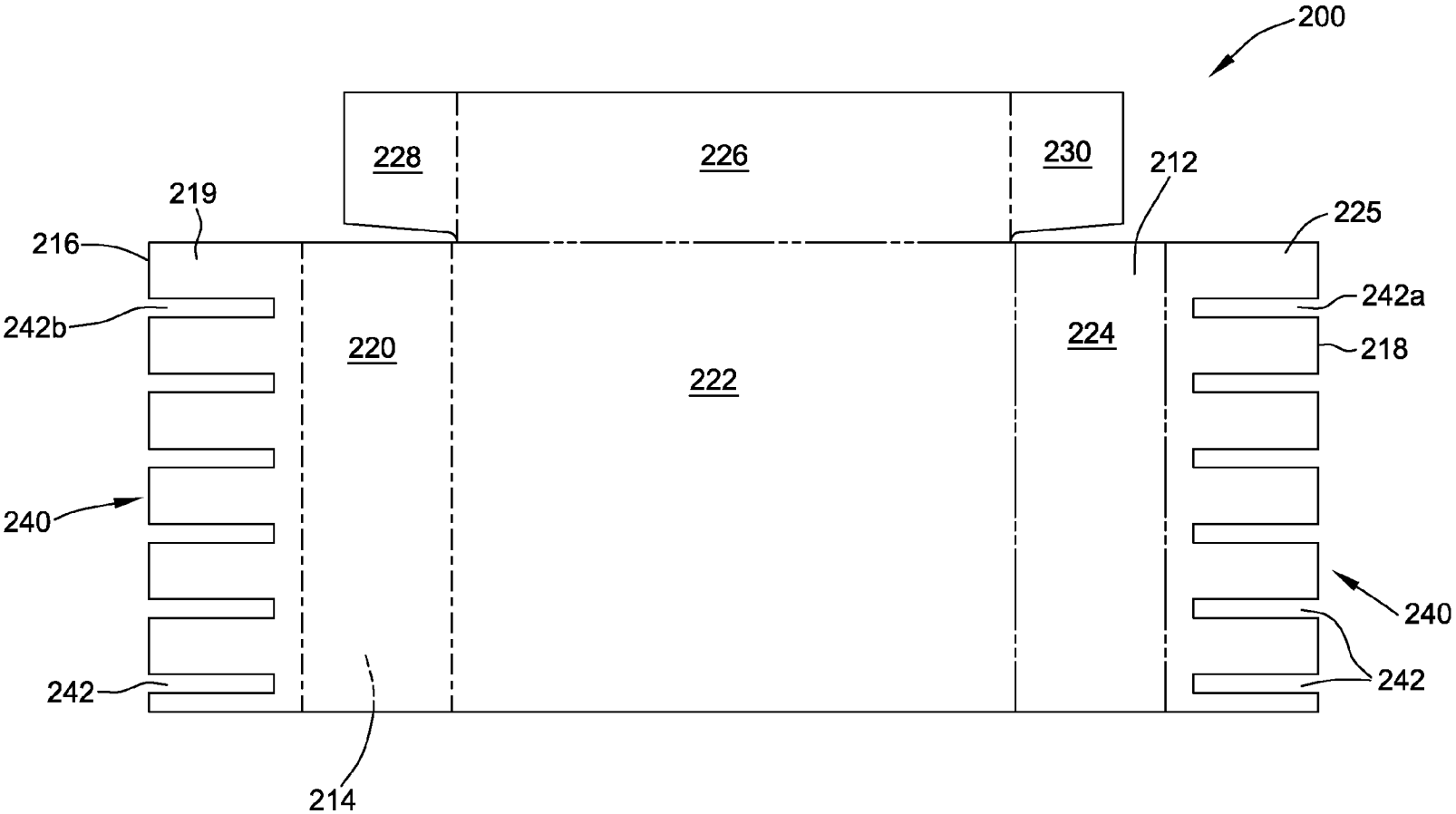
FIG. 4 is a top plan view of a blank of sheet material for forming a first alternative embodiment of a tray described herein.

FIG. 4 is a top view of an exemplary blank 200 of sheet material for forming a tray, such as a tray 300 (shown in FIGS. 5-10). Blank 200 has a first or interior surface 212 and an opposing second or exterior surface 214. Further, blank 200 defines a first edge 216 and an opposing second edge 218. In one embodiment, blank 200 includes, in series from first edge 216 to second edge 218, a first divider panel 219, a first end panel 220, a bottom panel 222, a second end panel 224, and a second divider panel 225 coupled together along preformed, generally parallel, fold lines. Fold lines and/or hinge lines described herein, may include any suitable line of weakening and/or line of separation known to those skilled in the art and guided by the teachings herein provided.

In the exemplary embodiment, extending from bottom panel 222 is a rear-side panel 226 having opposing glue tabs 228 and 230 extending therefrom.

Blank 200 includes first divider panel 219 and second divider panel 225. Each divider panel 219 and 225 defines a divider panel assembly 240, which are similar to divider panel assemblies 68 shown in FIG. 1. In the example embodiment, each divider panel assembly 240 is configured similarly having a plurality of support slots 242. In the example embodiment, a pairs of support slots, such as support slots 242*a* and 242*b*, are aligned with one another such that the pair of support slots cooperates with one another to support the containers being shipped within tray 300. In the exemplary embodiment, divider panel assemblies 240 have any suitable size and/or configuration based on the containers supported by tray 300. Further, divider panel assemblies 240 are configured to cooperate with an adjacent divider panel assembly 240 to secure the containers within tray 300. For example, each of the containers is contacted by two divider panel assemblies 240.

In the exemplary embodiment, support slots 242 are configured to engage the rim member of the containers being shipped within tray 300 when tray 300 is erected. More specifically, when tray 300 is erected, first end panel 220 is rotated upwardly such that it is substantially perpendicular to bottom panel 222, and second end panel 224 is rotated upwardly such that it is substantially perpendicular to bottom panel 222. First divider panel 219 is then rotated downwardly toward bottom panel 222 such that it is either (i) substantially parallel to bottom panel 222, (ii) extends at an angle toward bottom panel 222, or (iii) substantially perpendicular to bottom panel 222 and in a generally face-to-face relationship with first end panel 220. Second divider panel 225 is then rotated downwardly toward bottom panel 222 such that it is either (i) substantially parallel to bottom panel 222, (ii) extends at an angle toward bottom panel 222, or (iii) substantially perpendicular to bottom panel 222 and in a generally face-to-face relationship with second end panel 224.

The containers being shipped within tray 300 are then placed within tray 300 such that the rim member of each container being shipped is inserted within support slots 242. Accordingly, each shipped container is supported within tray 300 during shipment and display. This support helps prevent movement of the containers within tray 300 during shipment, and also facilitates improved display of the containers within tray 300 when being sold within the store.

In one embodiment, a single support slot 242, such as support slot 242*a*, is used to support a container being shipped within tray 300. In another embodiment, two support slots 242 positioned across from one another, such as support slots 242*a* and 242*b*, are used in combination to support a single container being shipped within tray 300.

In one embodiment, tray 300 is placed inside a shipping carton during shipment of the containers. Once at the store, tray 300 is then removed from the shipping carton, and tray 300 is used to display the product containers on shelves within the store for sale.

Figure 5:
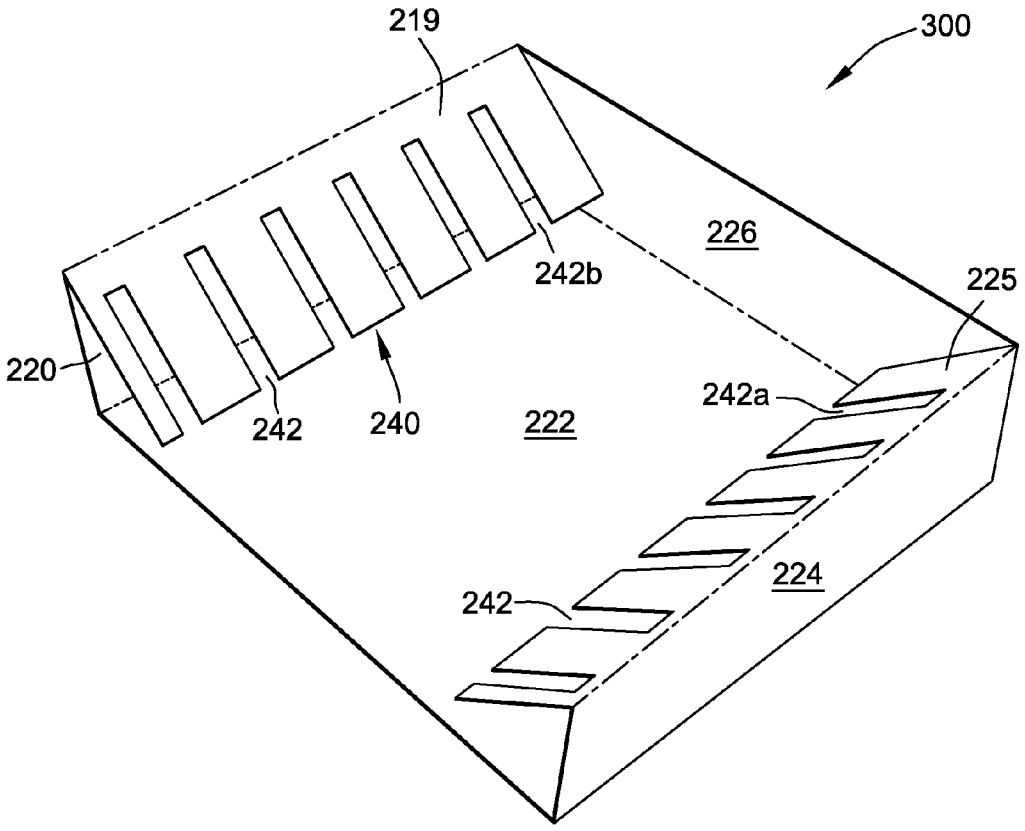
FIGS. 5 and 6 are perspective views of a first embodiment of the tray formed from the blank shown in FIG. 4.
Figure 6:
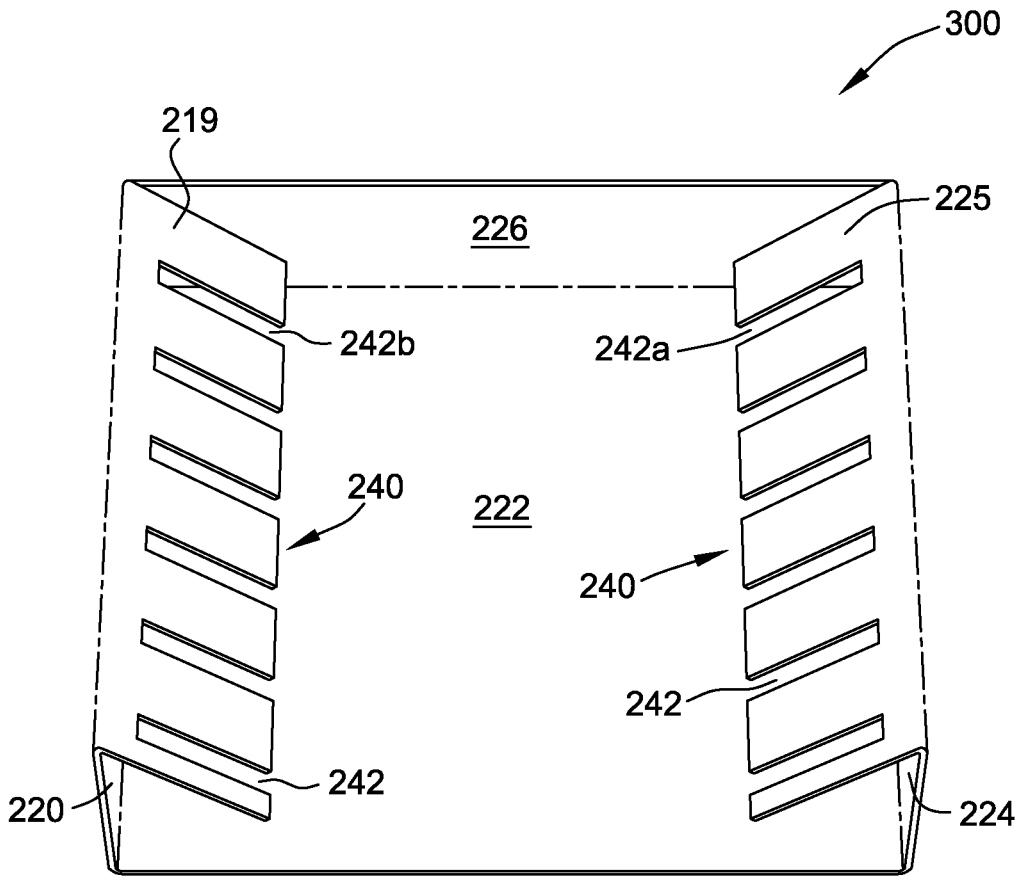

FIGS. 5 and 6 are perspective views of a first embodiment of tray 300 formed from blank 200 (shown in FIG. 4). The first embodiment includes first divider panel 219 and second divider panel 225 extending at an angle toward bottom panel 222. Elements of blank 200 shown in FIGS. 5 and 6 that are identical to elements shown in FIG. 4 are shown using the same numeric character references.

Figure 7:
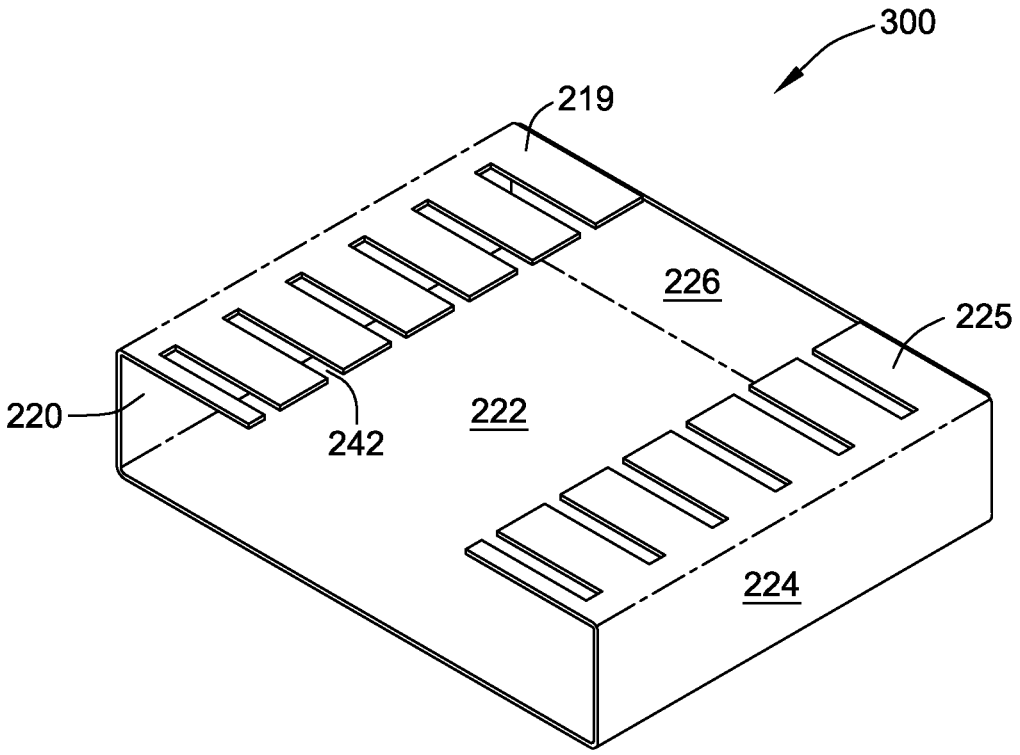
FIGS. 7 and 8 are perspective views of a second embodiment of the tray formed from the blank shown in FIG. 4.
Figure 8:
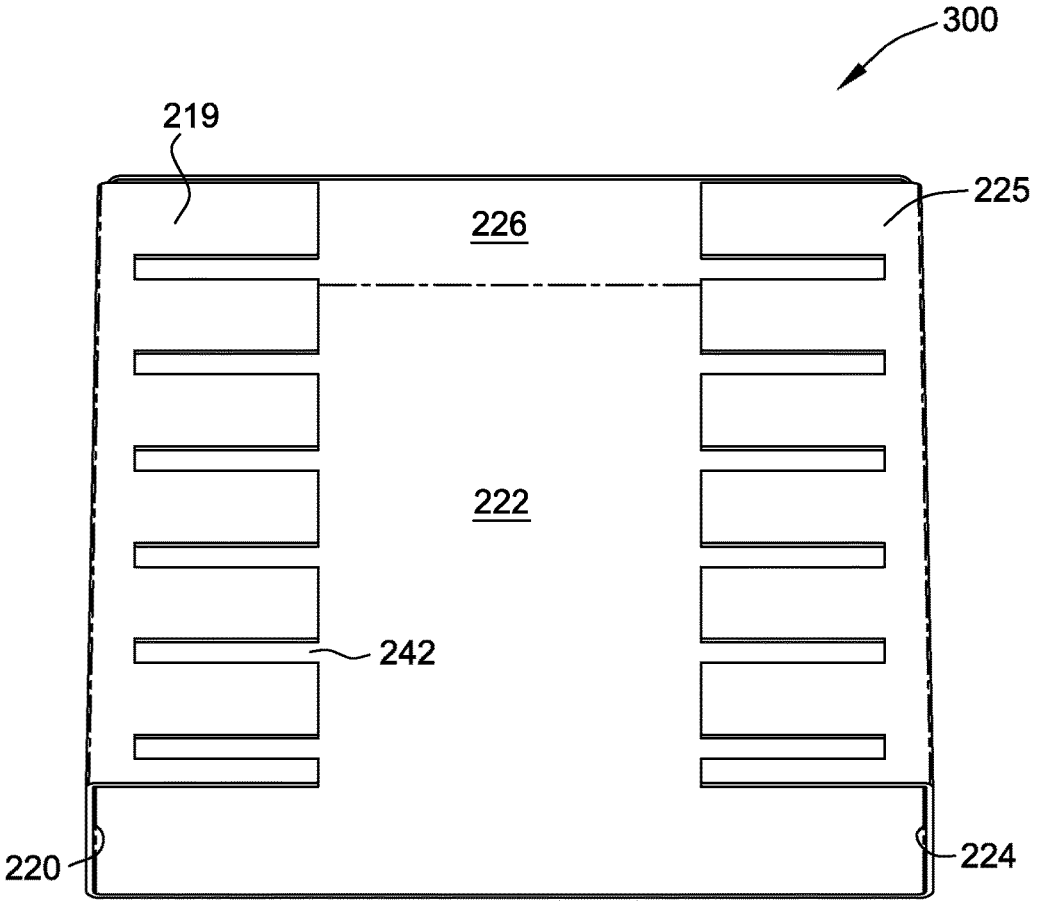

FIGS. 7 and 8 are perspective views of a second embodiment of tray 300 formed from blank 200 (shown in FIG. 4). The second embodiment includes first divider panel 219 and second divider panel 225 extending substantially parallel to bottom panel 222. Elements of blank 200 shown in FIGS. 7 and 8 that are identical to elements shown in FIG. 4 are shown using the same numeric character references.

Figure 9:
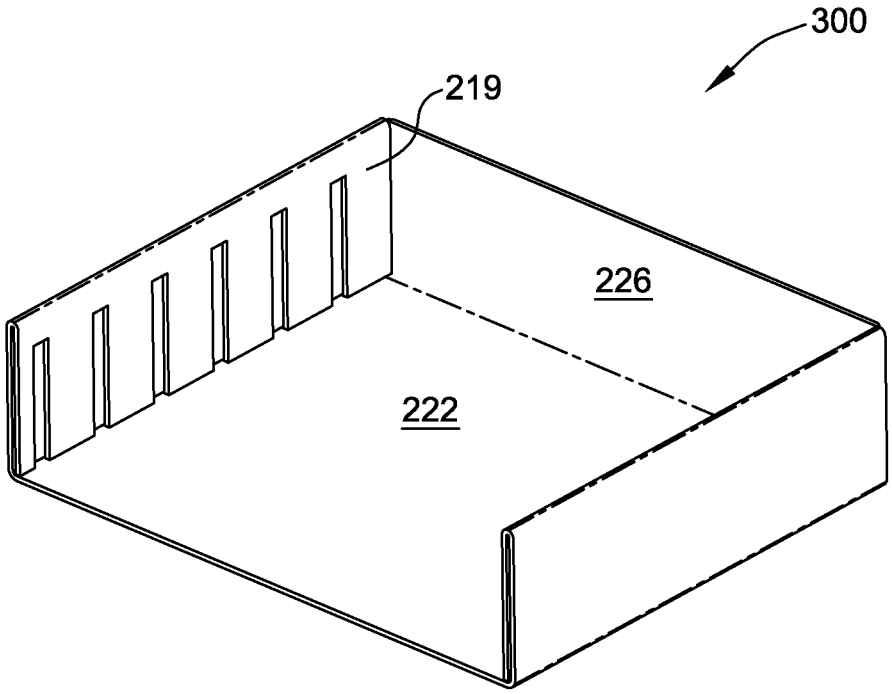
FIGS. 9 and 10 are perspective views of a third embodiment of the tray formed from the blank shown in FIG. 4.
Figure 10:
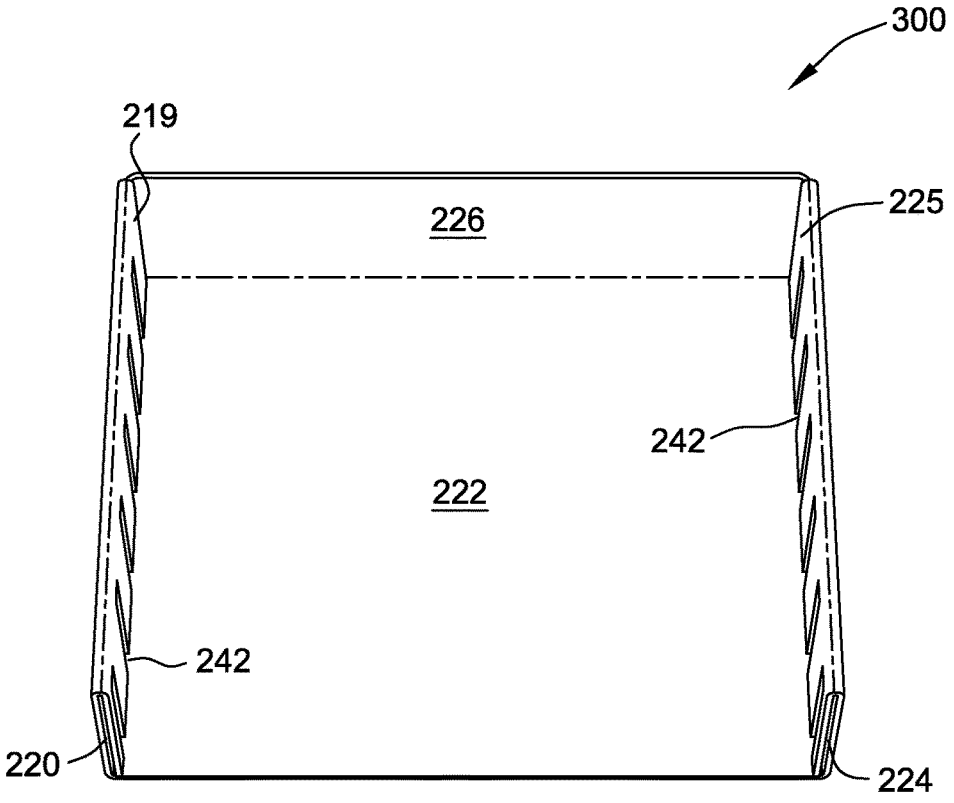

FIGS. 9 and 10 are perspective views of a third embodiment of tray 300 formed from blank 200 (shown in FIG. 4). The third embodiment includes first divider panel 219 and second divider panel 225 extending substantially perpendicular to bottom panel 222. Elements of blank 200 shown in FIGS. 9 and 10 that are identical to elements shown in FIG. 4 are shown using the same numeric character references.

Figure 11:
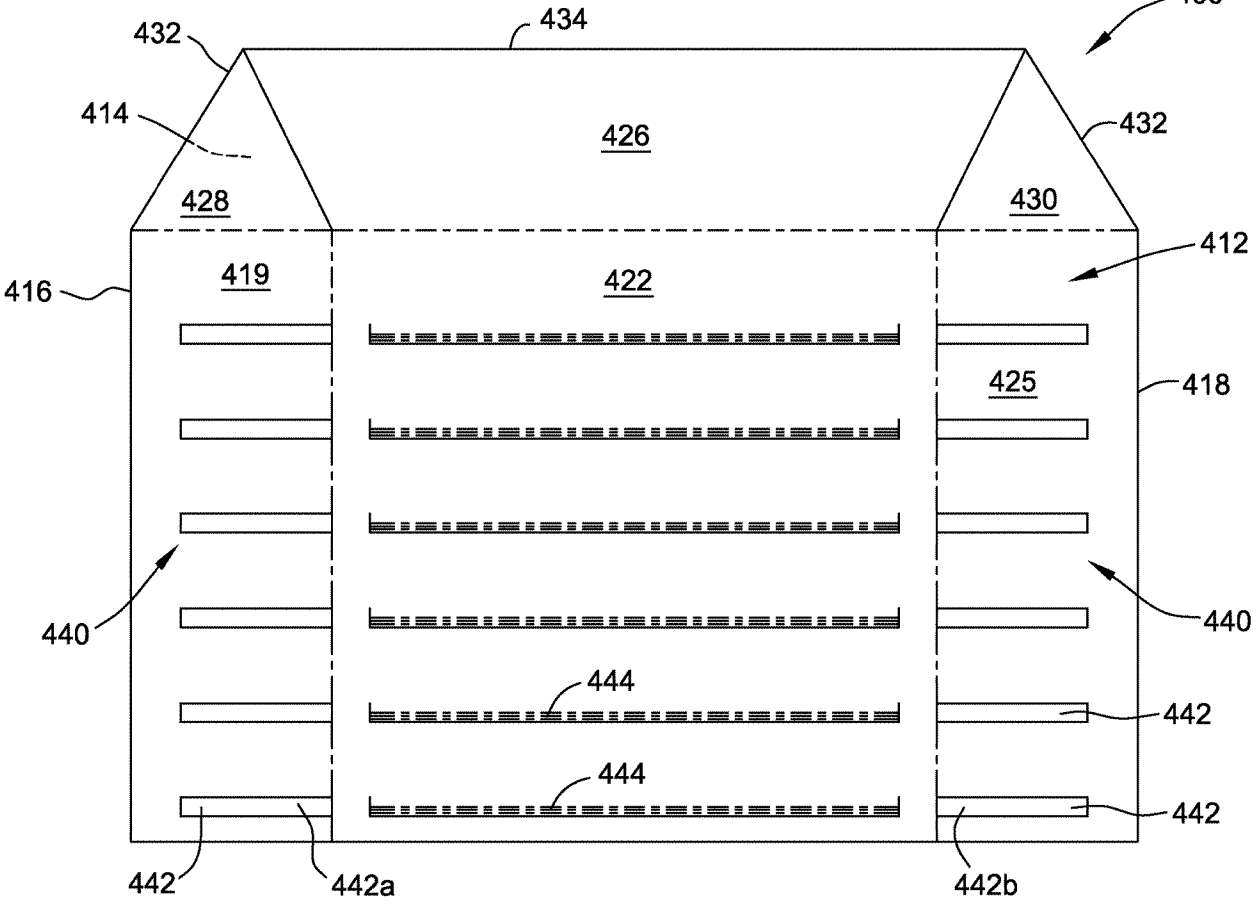
FIG. 11 is top plan view of a blank of sheet material for forming a second alternative embodiment of a tray described herein.
Figure 12:
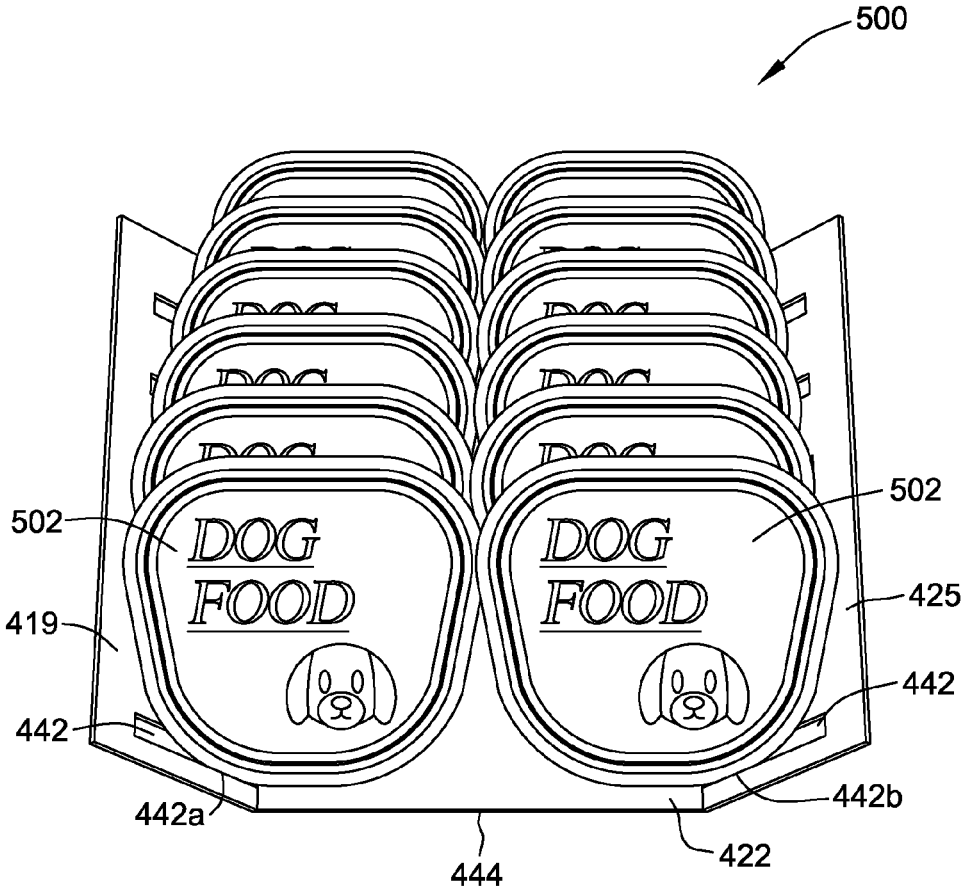
FIG. 12 is perspective views of a tray formed from the blank shown in FIG. 11.

FIG. 11 is a top view of an exemplary blank 400 of sheet material for forming a single tray, such as a tray 500 (shown in FIG. 12). Blank 400 has a first or interior surface 412 and an opposing second or exterior surface 414. Further, blank 400 defines a first edge 416 and an opposing second edge 418. In one embodiment, blank 400 includes, in series from first edge 416 to second edge 418, a first divider panel 419, a bottom panel 422, and a second divider panel 425 coupled together along preformed, generally parallel, fold lines. Fold lines and/or hinge lines described herein, may include any suitable line of weakening and/or line of separation known to those skilled in the art and guided by the teachings herein provided.

In the exemplary embodiment, extending from bottom panel 422 is a rear-side panel 426. Extending from first divider panel 419 is a first glue tab 428, and extending from second divider panel 425 is a second glue tab 430. As explained below, glue tabs 428 and 430 include an outer edge 432. Glue tabs 428 and 430 are configured to be glued to rear-side panel 426 such that outer edges 432 are substantially aligned with an upper edge 434 of rear-side panel 426. By coupling glue tabs 428 and 430, which are attached to first divider panel 419 and second divider panel 425, respectively, via fold lines, to rear-side panel 426, first divider panel 419 and second diver panel 425 are positioned at an angle relative to bottom panel 422.

Blank 400 includes first divider panel 419 and second divider panel 425. Each divider panel 419 and 425 defines a divider panel assembly 440, which are similar to divider panel assemblies 68 shown in FIG. 1. In the example embodiment, each divider panel assembly 440 is configured similarly having a plurality of support slots 442. In the example embodiment, a pair of support slots, such as support slots 442*a* and 442*b*, are aligned with one another such that the pair of support slots cooperates with one another to support the containers being shipped within tray 500. In an alternative embodiment, support slots 442*a* and 442*b* are offset from one another such that the containers being shipped are only supported by one of the support slots and the containers are staggered within tray 500. In the exemplary embodiment, divider panel assemblies 440 have any suitable size and/or configuration based on the containers supported by tray 500. Further, divider panel assemblies 440 may be configured to cooperate with an adjacent divider panel assembly 440 to secure the containers within tray 500. For example, each of the containers may be contacted by two divider panel assemblies 440.

Bottom panel 422 includes bottom slots 444. Each bottom slot 444 includes at least one cut line and several lines of weakness (i.e., score lines) wherein the sheet material is also crushed. The cut line(s) and the crushed material define slot 444 which is configured to further support and engage the rim member of the container being shipped. The lines of weakness and crushed material enable the blank material to remain within bottom slots 444 but still act as a support or a means of engagement for receiving the rim member. Each bottom slot 444 is generally aligned with two opposing support slots 442.

In the exemplary embodiment, support slots 442 and bottom slots 444 are configured to engage the rim member of the containers being shipped within tray 500 when tray 500 is erected. More specifically, when tray 500 is erected, first divider panel 419 is rotated upwardly and first glue tab 428 is coupled to rear-side panel 426 such that outer edge 432 of first glue tab 428 is substantially aligned with upper edge 434 of rear-side panel 426; and second divider panel 425 is rotated upwardly and second glue tab 430 is coupled to rear-side panel 426 such that outer edge 432 of second glue tab 430 is substantially aligned with upper edge 434 of rear-side panel 426. By so doing, first divider panel 419 and second divider panel 425 are held in position at an angle relative to bottom panel 422.

The containers being shipped within tray 500 are then placed within tray 500 such that the rim member of each container being shipped is inserted within at least one support slot 442 and a corresponding bottom slot 444. Accordingly, each shipped container is supported within tray 500 during shipment and display. This support helps prevent movement of the containers within tray 500 during shipment, and also facilitates improved display of the containers within tray 500 when being sold within the store.

In one embodiment, a single support slot 442, such as support slot 442*a*, is used to support a container being shipped within tray 500. In another embodiment, two support slots 442 positioned across from one another, such as support slots 442*a* and 442*b*, are used in combination to support a single container being shipped within tray 500.

In one embodiment, tray 500 is placed inside a shipping carton during shipment of the containers. Once at the store, tray 500 is then removed from the shipping carton, and tray 500 is used to display the product containers on shelves within the store for sale.

FIG. 12 is a perspective view of an exemplary embodiment of tray 500 formed from blank 400 (shown in FIG. 11). In this exemplary embodiment, dog food containers 502 are shown within tray 500. Containers 502 are placed within tray 500 such that the rim member of each container 502 is inserted within one support slot 442 (e.g., support slot 442*a* or 442*b*) and corresponding bottom slot 444. Accordingly, each shipped container 502 is supported within tray 500 during shipment and display. This support helps prevent movement of the containers within tray 500 during shipment, and also facilitates improved display of the container products within tray 500 when being sold within the store.

In FIG. 12, a single support slot 442, such as support slot 442*a*, in combination with bottom slot 444 is used to support a first container 502; while another support slot 442, such as support slot 442*b*, in combination with bottom slot 444 is used to support a second container 502 being shipped within tray 500. Thus, in the example embodiment, containers 502 are slightly staggered within tray 500 to reduce movement of container 502 during shipment and maximize shipping space. Containers 502 can then be easily viewed by consumers when tray 500 is placed on a shelf at the store.

When erected, tray 500 is configured to hold the containers (e.g., containers or blister packages) being shipped within tray 500 in an upright position to: (i) secure the containers within tray 500, (ii) prevent movement of the containers during shipment, (iii) maximize the number of containers being shipped within tray 500, (iv) display the display face of the containers when tray 500 is placed on a shelf at a point of sale so that the display face is clearly visible to potential customers, and (v) make each container individually accessible by a customer when tray 500 is placed on a shelf at a point of sale. By making the containers individually accessible, a consumer can easily see different products (i.e., different flavors, etc.) stored within the containers and can easily retrieve one or more of the containers without having to search and move other containers that may be blocking the view of the consumer.

Figure 13:
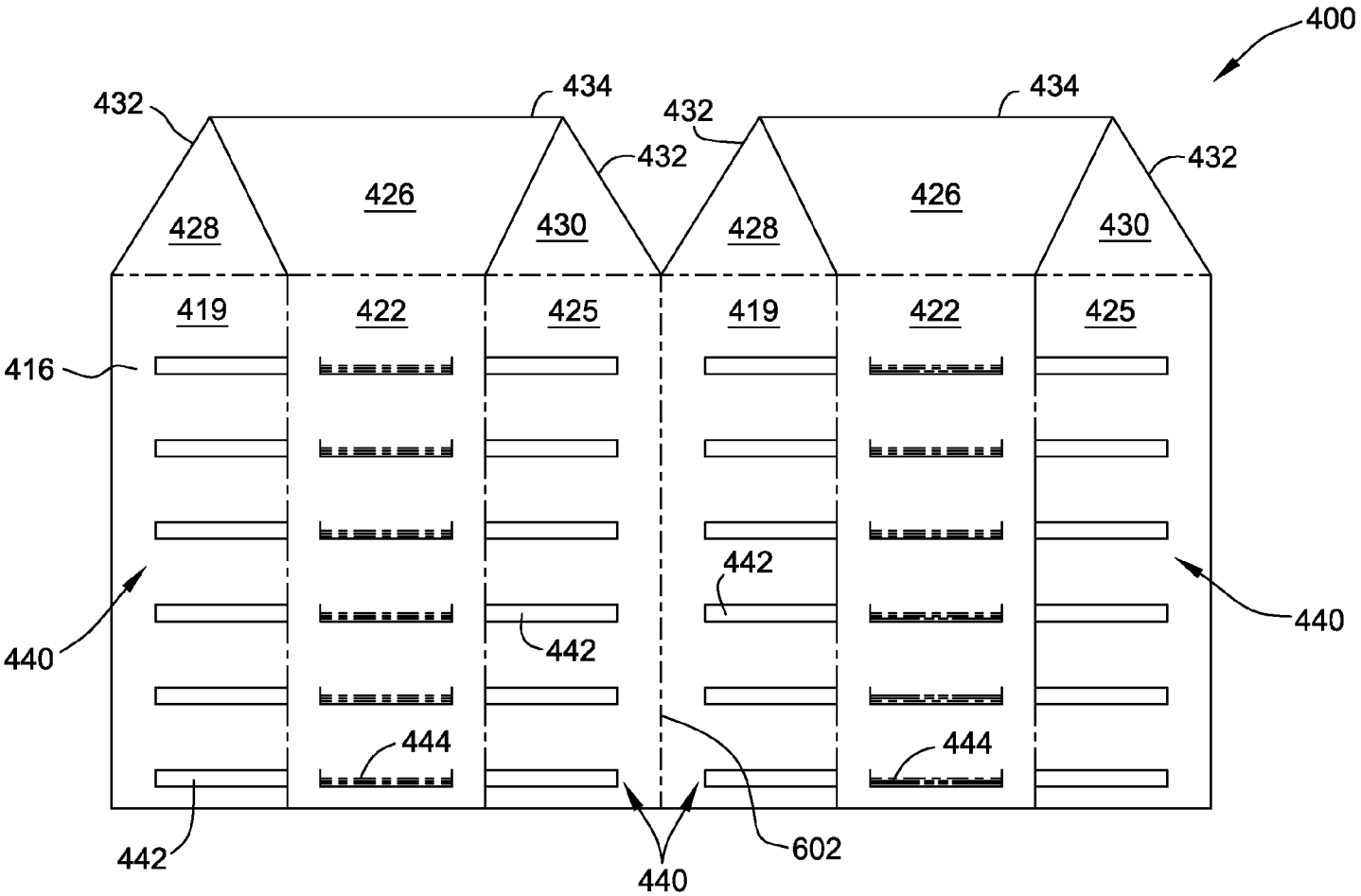
FIG. 13 is a top plan view of a blank of sheet material for forming a third alternative embodiment of a tray described herein.
Figure 14:
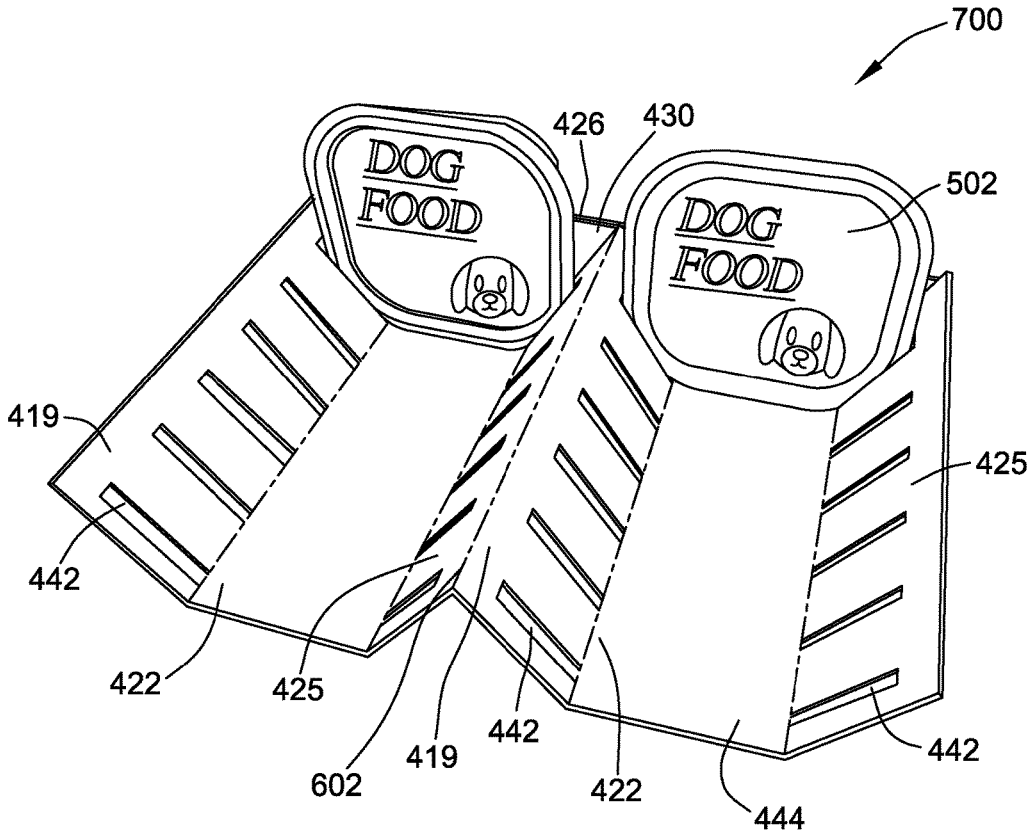
FIGS. 14 and 15 are perspective views of a tray formed from the blank shown in FIG. 13.
Figure 15:
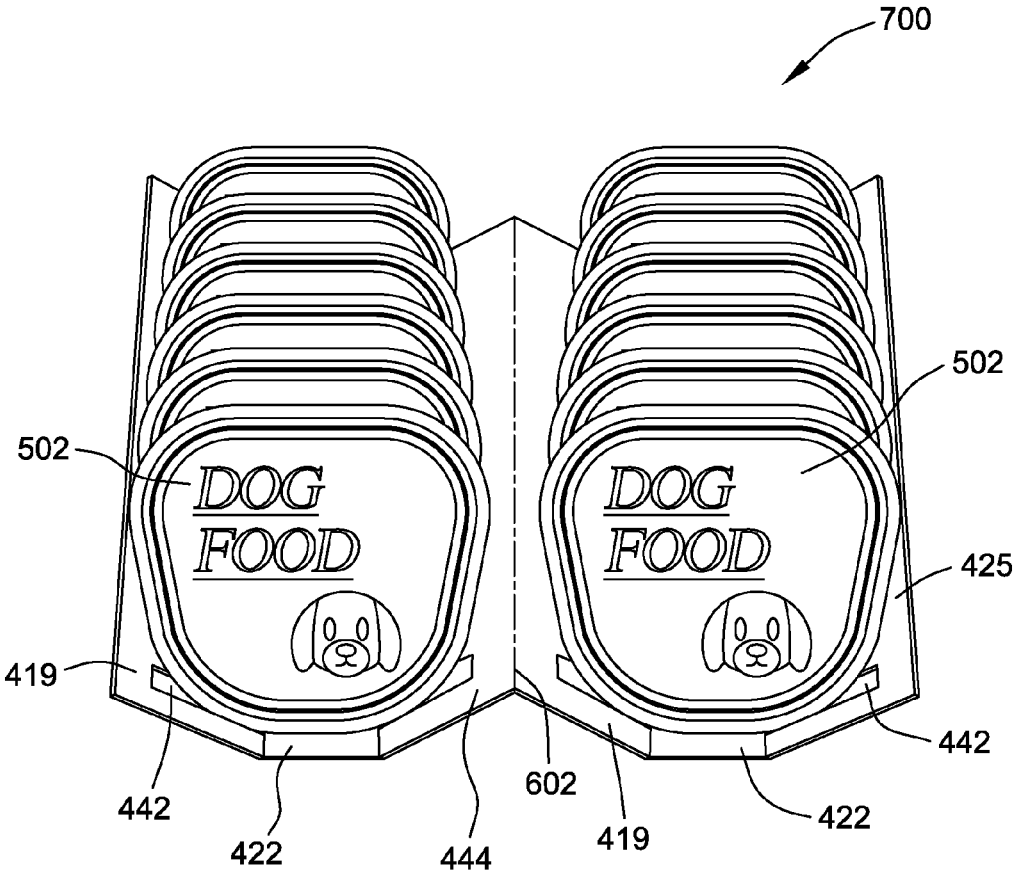

FIG. 13 is a top view of an exemplary blank 600 of sheet material for forming a double tray, such as a tray 700 (shown in FIGS. 14 and 15). Blank 600 is similar to blank 400 shown in FIG. 11 except that blank 600 includes two blanks 400 positioned in a side-by-side relationship and coupled together along fold line 602. Accordingly, elements of blank 600 that are identical to elements of blank 400 shown in FIG. 11 are shown using the same numeric character references.

FIGS. 14 and 15 are perspective views of an exemplary embodiment of double tray 700 formed from blank 600 (shown in FIG. 13). In this exemplary embodiment, dog food containers 502 are shown within tray 700. Double tray 700 is similar to tray 500 shown in FIG. 12. Accordingly, elements of tray 700 that are identical to elements of tray 500 shown in FIG. 12 are shown using the same numeric character references.

Figure 16:
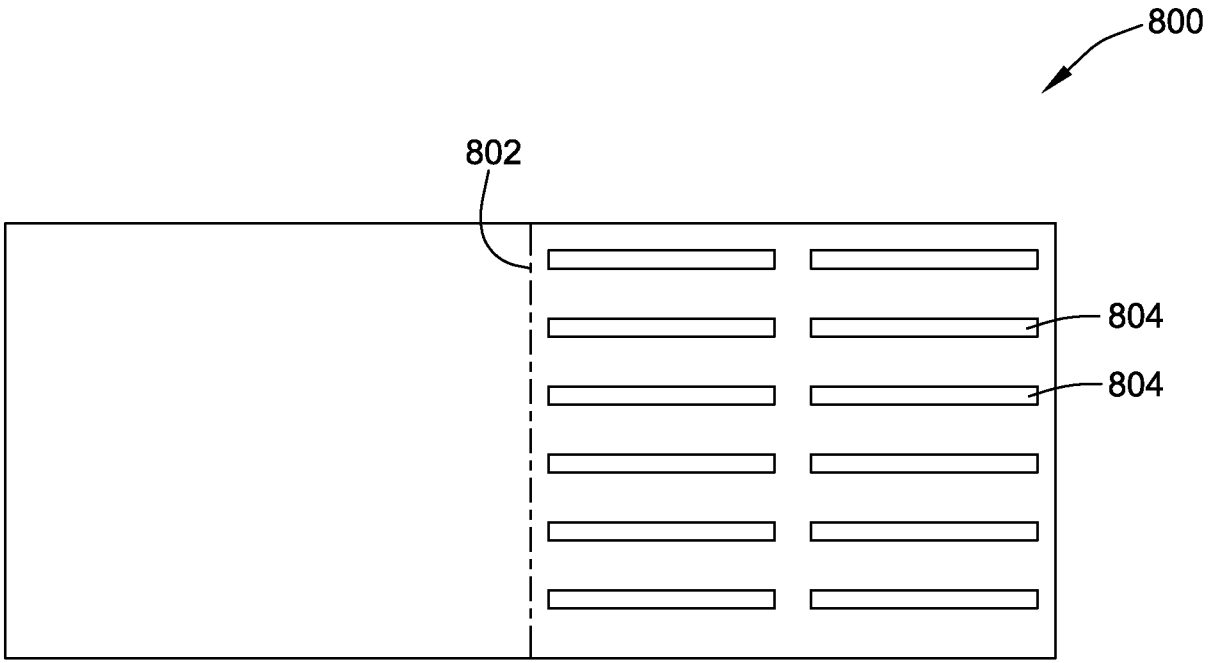
FIG. 16 is a top plan view of a blank of sheet material for forming a fourth alternative embodiment of a tray described herein.

FIG. 16 is a top view of an exemplary blank 800 of sheet material for forming a tray. Blank 800 is a flat piece of sheet material having a fold line 802 extending along a generally transverse axis of blank 800. Blank 800 also includes bottom slots 804. Bottom slots 804 are cut-outs that are configured to receive the rim member of a container being shipped on the tray formed from blank 800. Blank 800 is configured to fold back on itself along fold line 802 to form a double layer tray with the top layer of the tray having the bottom slots 804. Containers are then inserted into the bottom slots 804 for shipment and display. For shipment, the tray is placed inside a shipping carton. The tray can then be removed from the carton for display purposes.

Figure 17:
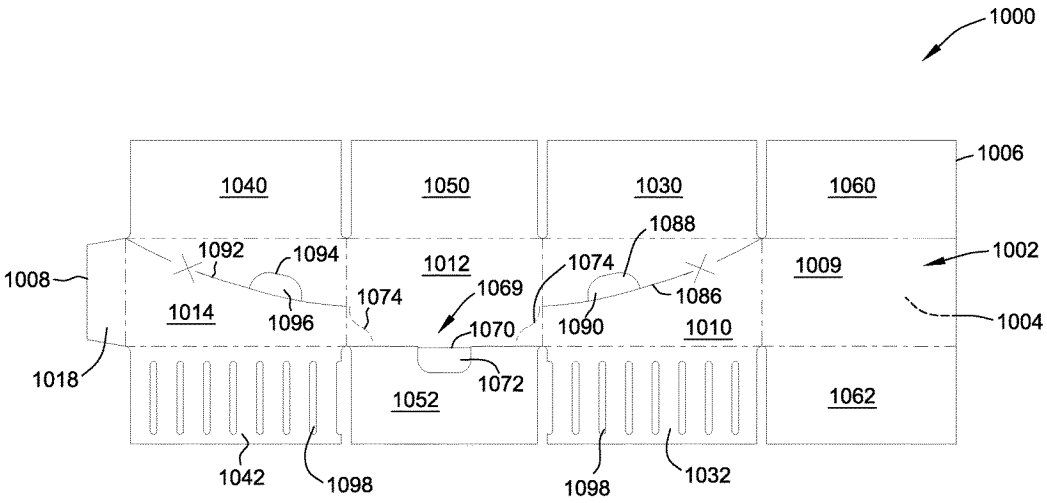
FIG. 17 is a top plan view of blank of sheet material for forming a fifth alternative embodiment of a tray described herein.
Figure 18:
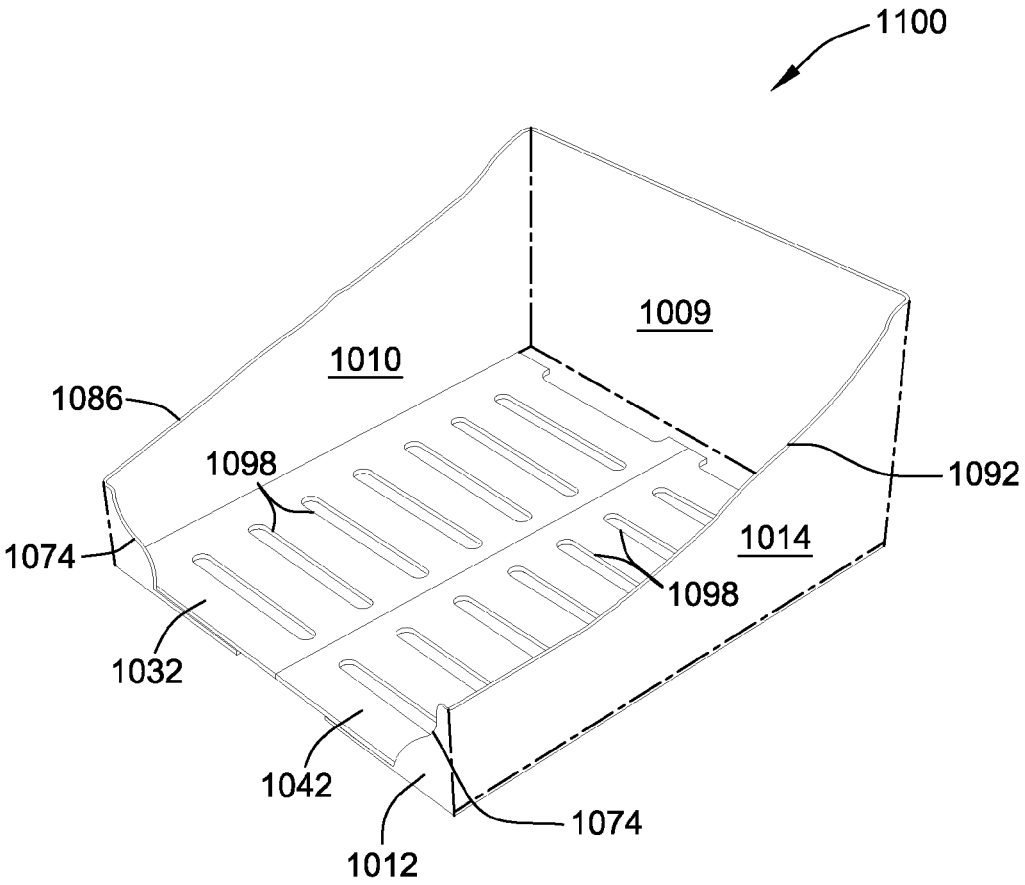
FIG. 18 shows a perspective view of a tray formed from the blank shown in FIG. 17.

FIG. 17 is a top plan view of an exemplary blank 1000 of sheet material for forming a tray, such as tray 1100 shown in FIG. 18. Blank 1000 has a first or interior surface 1002 and an opposing second or exterior surface 1004. Further, blank 1000 includes a leading edge 1006 and an opposing trailing edge 1008. In one embodiment, blank 1000 includes, from leading edge 1006 to trailing edge 1008, a back end panel 1009, a first side panel 1010, a front end panel 1012, a second side panel 1014, and a glue flap 1018 coupled together along preformed, generally parallel, fold lines. Fold lines as well as other hinge lines described herein, may include any suitable line of weakening and/or line of separation known to those skilled in the art and guided by the teachings herein provided.

First side panel 1010 includes a first top side panel 1030 and a first bottom side panel 1032 extending therefrom along respective fold lines. Similarly, second side panel 1014 includes a second top side panel 1040 and a second bottom side panel 1042 extending therefrom along respective fold lines. Front end panel 1012 includes a front top end panel 1050 and a front bottom end panel 1052 extending therefrom along respective fold lines. Similarly, back end panel 1009 includes a back top end panel 1060 and a back bottom end panel 1062 extending therefrom along respective fold lines.

An opening assembly 1069 includes a lip 1070 extending from the bottom of front end panel 1012, and an access gap 1072. A perforation line 1074 extends arcuately from a bottom fold line to a side fold line on both sides of lip 1070. In one embodiment, the arcuate path is simple and in another embodiment the arcuate path is compound or complex.

First side panel 1010 includes a perforation line 1086 that extends from the intersection of perforation line 1074 and the side fold line to the top rear corner of first side panel 1010. Perforation line 1086 includes a cut out 1088 that defines an access opening 1090 in first side panel 1010. Cut out 1088 is positioned on the upper side of perforation line 1086.

Similarly, second side panel 1014 includes a perforation line 1092 that extends from the intersection of perforation line 1074 and the side fold line to the top rear corner of second side panel 1014. Perforation line 1092 includes a cut out 1094 that defines an access opening 1096 in second side panel 1014. Cut out 1094 is positioned on the upper side of perforation line 1092.

In addition, the exemplary embodiment may include a cut-out, score lines, or perforation lines on front bottom end panel 1052 to facilitate a user to insert fingers within access gap 1072 for pulling on opening lip 1070.

First bottom side panel 1032 and second bottom side panel 1042 include bottom slots 1098 that are configured to receive rim members of the containers being shipped and displayed within the tray formed from blank 1000.

FIG. 18 shows a perspective view of an exemplary embodiment of a tray 1100 formed from blank 1000 (shown in FIG. 17). In this exemplary embodiment, the convertible tray 1100 has been converted from a shipping tray to a display tray by removing a portion of first side panel 1010, front end panel 1012, and second side panel 1014 along perforation lines 1074, 1086 and 1092. The containers shipped within tray 1100 are inserted into bottom slots 1098 that help define the bottom of tray 1100.

Figure 19:
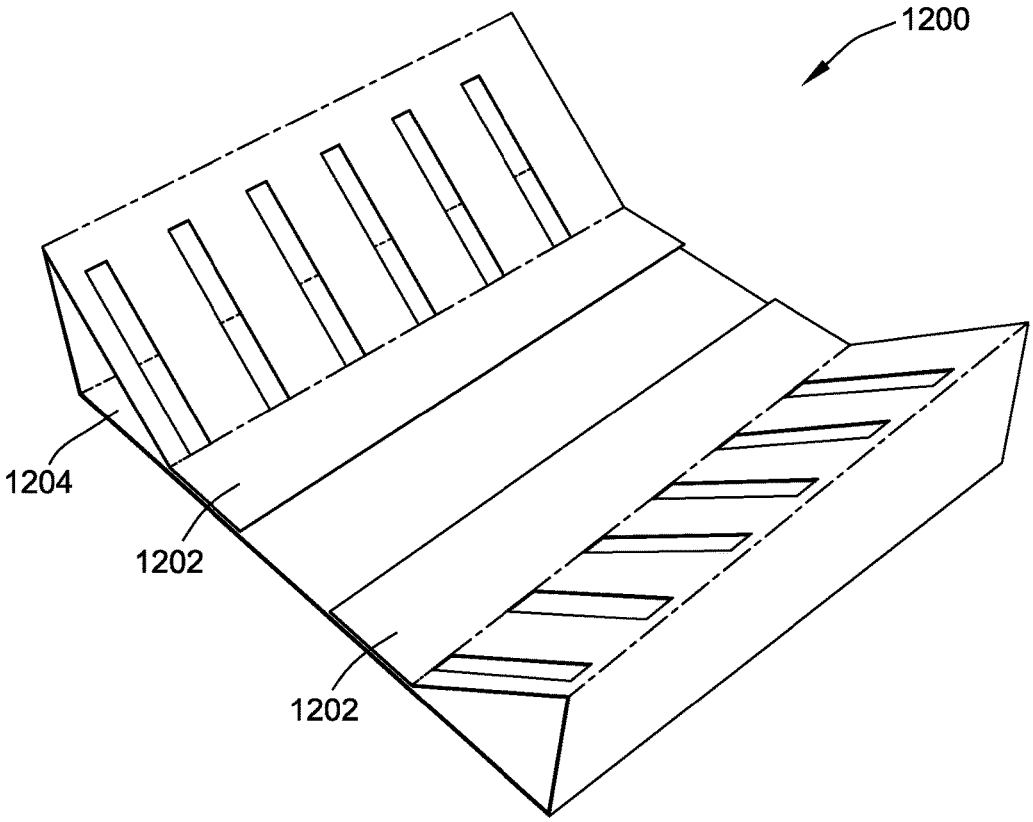
FIG. 19 is a perspective view of a sixth alternative embodiment of a tray described herein.
Figure 20:
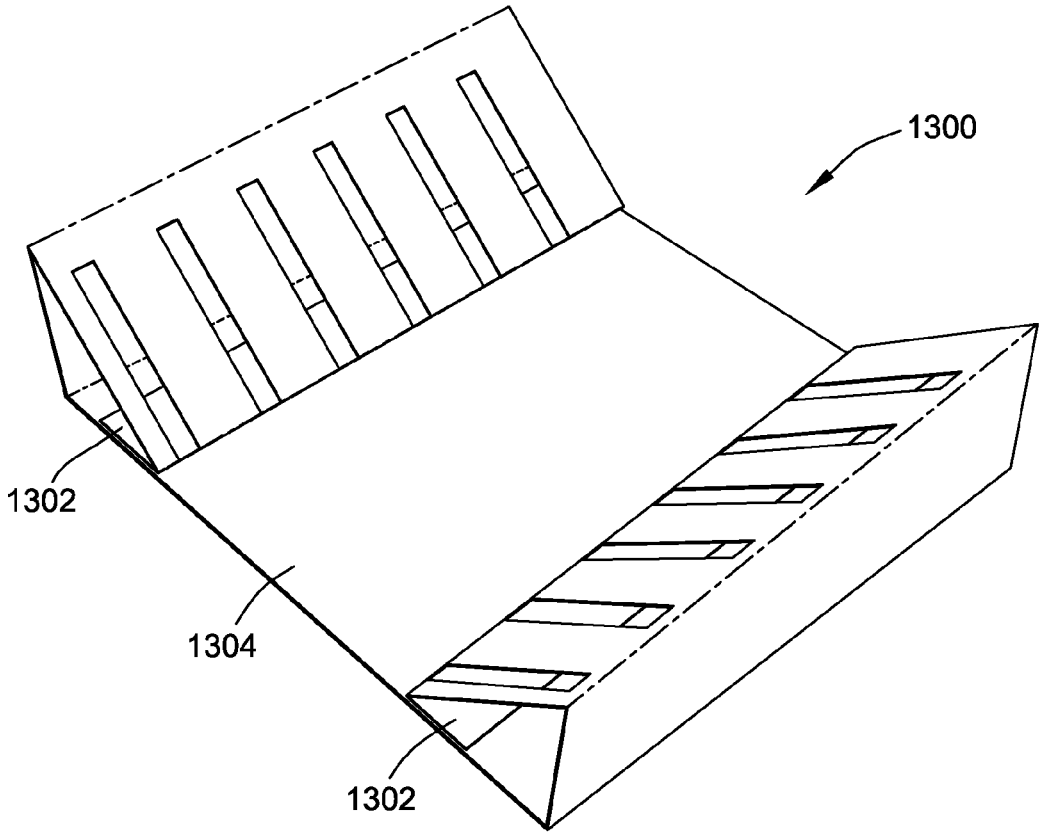
FIG. 20 is a perspective view of a seventh alternative embodiment of a tray described herein.
Figure 21:
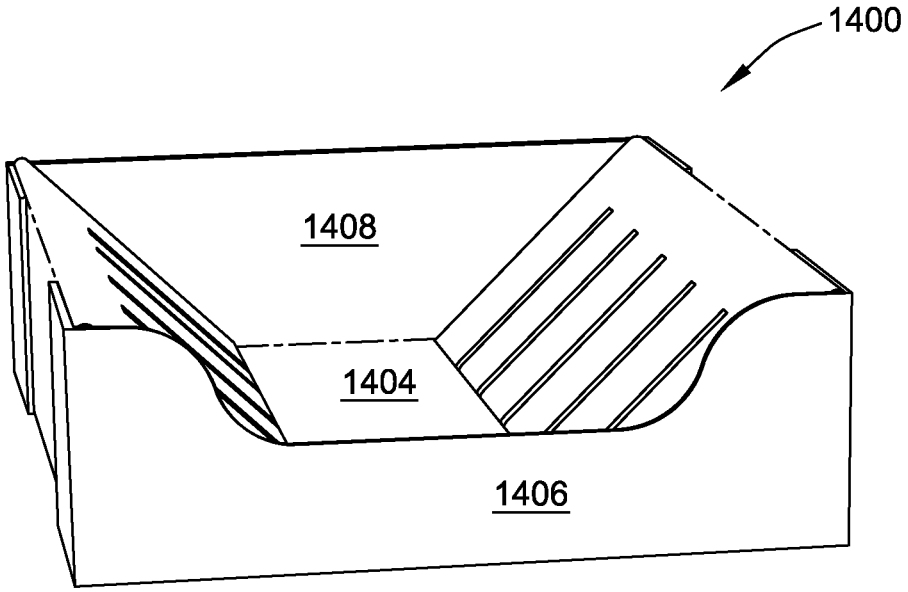
FIG. 21 is a perspective view of an eighth alternative embodiment of a tray described herein.

FIG. 19 is a perspective view of an exemplary embodiment of a tray 1200. FIG. 20 is a perspective view of an exemplary embodiment of a tray 1300. FIG. 21 is a perspective view of an exemplary embodiment of a tray 1400. Tray 1200 shows glue flaps or inner panels 1202 extending inwardly toward one another and glued to bottom panel 1204. In contrast, tray 1300 shows glue flaps or inner panels 1302 extending outwardly away from one another and glued to bottom panel 1304. Tray 1400 is similar to tray 1300 in that the glue flaps (not shown) extend outwardly away from one another and are glued to the bottom panel 1404. In addition, tray 1400 includes a front end panel 1406 and a rear end panel 1408.

The embodiments described herein include a blank for forming a tray for shipping and displaying at least one product. The blank includes a bottom panel; a pair of opposed side panels connected to the bottom panel; and at least one divider panel assembly connected to the bottom panel and one of the side panels, wherein the at least one divider panel assembly includes a plurality of support slots configured to receive a portion of at least one of the containers to secure the container to the tray, to display the containers within the tray, and to enable individual access to each of the containers within the tray. The blank further includes a pair of opposed end panels connected to the bottom panel. The blank further includes at least one pair of opposed end flaps connected to one side panel. The blank further includes the at least one divider panel assembly having an inner panel and an upper panel. The blank further includes the inner panel being connected to the bottom panel and the upper panel. The blank further includes the upper panel being connected to one of the side panels and the inner panel. The blank further includes the plurality of support slots being formed in the upper panel. The blank further includes the inner panel being formed from a cutout of the bottom panel. The blank further includes the upper panel being formed from a cutout of one of the side panels. The blank further includes each upper panel extending diagonally from one of the side panels to one of the inner panels, wherein each inner panel is attached to the bottom panel.

The embodiments described herein include a tray formed from a blank of sheet material. The tray is for shipping and displaying at least one product. The tray includes a bottom wall; a pair of opposed side walls connected to the bottom wall; and at least one divider panel assembly connected to the bottom wall and one of the side walls, wherein the at least one divider panel assembly includes a plurality of support slots configured to receive a portion of at least one of the containers to secure the container to the tray, to display the containers within the tray, and to enable individual access to each of the containers within the tray. The tray further includes a pair of opposed end walls connected to the bottom wall. The tray further includes at least one pair of opposed end flaps connected to one side wall. The tray further includes at least one divider panel assembly having an inner panel wall oriented substantially parallel to one side wall, and an upper panel wall oriented substantially parallel to the bottom wall. The tray further includes the inner panel wall being connected to the bottom wall and the upper panel wall. The tray further includes the upper panel wall being connected to one of the side walls and the inner panel wall. The tray further includes the plurality of support slots being formed in the upper panel wall. The tray further includes the inner panel wall being formed from a cutout of the bottom wall. The tray further includes the upper panel wall being formed from a cutout of one of the side walls. The tray further includes the at least one divider panel assembly having an inner panel wall, and an upper panel wall, wherein each upper panel wall extends diagonally from one of the side walls to one of the inner panel walls, and wherein each inner panel wall is attached to the bottom wall.

The embodiments described herein include a blank for forming a tray for shipping and displaying at least one product. The blank includes a bottom panel; a pair of opposed end panels connected to the bottom panel; and at least one divider panel connected to one of the end panels, wherein the at least one divider panel includes a plurality of support slots configured to receive a portion of at least one of the containers to secure the container to the tray, to display the containers within the tray, and to enable individual access to each of the containers within the tray. The blank further includes a rear side panel connected to the bottom panel, and a pair of opposed tabs connected to the rear side panel. The blank further includes a front side panel connected to the bottom panel, and a pair of opposed tabs connected to the front side panel. The blank further includes at least one divider panel having a pair of opposed divider panels, wherein each divider panel is coupled to one of the opposed end panels. The blank further includes an adhesive flap connected to the at least one divider panel.

The embodiments described herein include a tray formed from a blank of sheet material. The tray is for shipping and displaying at least one product. The tray includes a bottom wall; a pair of opposed end walls connected to the bottom wall; and at least one divider panel wall connected to one of the end walls, wherein the at least one divider panel wall includes a plurality of support slots configured to receive a portion of at least one of the containers to secure the container to the tray, to display the containers within the tray, and to enable individual access to each of the containers within the tray. The tray further includes a rear side wall connected to the bottom wall, and a pair of opposed tabs connected to the rear side wall and coupled to the end walls. The tray further includes a front side wall connected to the bottom wall, and a pair of opposed tabs connected to the rear side wall and coupled to the end walls. The tray further includes the at least one divider panel wall being one of: oriented substantially parallel to the bottom wall, oriented at an angle to the bottom wall, and oriented substantially parallel to one of the end walls. The tray further includes an adhesive flap connected to the divider panel wall, wherein the divider panel wall is oriented at an angle to the bottom wall and the adhesive flap is coupled to the bottom wall.

The embodiments described herein include a blank for forming a tray for shipping and displaying at least one product. The blank includes at least one bottom panel; and at least one divider panel connected to the at least one bottom panel, wherein the at least one divider panel includes a plurality of support slots configured to receive a portion of at least one of the containers to secure the container to the tray, to display the containers within the tray, and to enable individual access to each of the containers within the tray. The blank further includes at least one rear side panel connected to the bottom panel. The blank further includes a tab connected to the at least one divider panel. The blank further includes the at least one bottom panel having a plurality of bottom slots configured to receive a portion of at least one of the containers to secure the container to the tray. The blank further includes the at least one bottom panel having a first bottom panel and a second bottom panel, and the at least one divider panel having a first divider panel connected to the first bottom wall and a second divider panel connected to the second bottom wall, and wherein the first divider panel is connected to the second divider wall.

The embodiments described herein include a tray formed from a blank of sheet material. The tray is for shipping and displaying at least one product. The tray further includes at least one bottom wall; and at least one pair of opposed divider walls connected to the bottom wall, wherein at least one of the divider walls includes a plurality of support slots configured to receive a portion of at least one of the containers to secure the container to the tray, to display the containers within the tray, and to enable individual access to each of the containers within the tray. The tray further includes at least one rear side wall connected to the bottom wall, wherein the at least one rear side wall includes an upper edge. The tray further includes a pair of opposed tabs, wherein each tab is connected to one of the opposed divider walls and coupled to the rear side wall, and each of the tabs include an outer edge. The tray further includes the tabs being coupled to the rear side wall such that the outer edges are substantially aligned with an upper edge of the rear side wall and wherein the divider walls are oriented at an angle to the bottom wall. The tray further includes the bottom wall having a plurality of bottom slots configured to receive a portion of at least one of the containers to secure the container to the tray. The tray further includes the at least one bottom wall having a first bottom wall and a second bottom wall, and the at least one pair of opposed divider walls having a first pair of divider panel walls connected to the first bottom wall and a second pair of divider panel walls connected to the second bottom wall, and wherein one divider wall of the first pair of divider walls is connected to one divider wall of the second pair of divider walls.

The embodiments described herein include a blank for forming a tray for shipping and displaying at least one product. The blank includes a front panel; a pair of opposed side panels connected to the front panel; and a pair of opposed bottom side panels connected to the side panels, wherein at least one bottom side panel includes a plurality of support slots configured to receive a portion of at least one of the containers to secure the container to the tray, to display the containers within the tray, and to enable individual access to each of the containers within the tray. The blank further includes the front panel having at least one perforated line configured to enable a portion of the front panel to be removed. The blank further includes at least one of the side panels having a perforated line configured to enable a portion of the side panel to be removed. The blank further includes a back end panel connected to one of the side panels, and at least one of: a back top end panel connected to the back end panel and a back bottom end panel connected to the back end panel. The blank further includes a top side panel connected to one of the side panels. The blank further includes an adhesive flap connected to one of the side panels. The blank further includes a front top end panel connected to the front panel.

The embodiments described herein include a tray formed from a blank of sheet material. The tray is for shipping and displaying at least one product. The tray includes a front wall; a pair of opposed side walls connected to the front wall; and a pair of opposed bottom walls connected to the side walls, wherein at least one of the bottom walls includes a plurality of support slots configured to receive a portion of at least one of the containers to secure the container to the tray, to display the containers within the tray, and to enable individual access to each of the containers within the tray. The tray further includes the front wall having at least one perforated line configured to enable a portion of the front panel to be removed to provide access to the containers secured to the tray. The tray further includes a portion of the front wall being removed along the at least one perforated line. The tray further includes at least one of the side walls having a perforated line configured to enable a portion of the side wall to be removed to provide access to the containers secured to the tray. The tray further includes a portion of the side wall being removed along the perforated line. The tray further includes a back end wall connected to one of the side walls. The tray further includes a front bottom end wall connected to the front wall, and a back bottom end wall connected to the back end wall, wherein the front bottom end wall and the back bottom end wall are positioned against the pair of opposed bottom walls. The tray further includes a back top end wall connected to the back end wall, and a front top end wall connected to the front wall, wherein the back top end wall and the front top end wall is oriented substantially coplanar. The tray further includes an adhesive flap that is connected to one of the side walls and coupled to the back end wall.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A blank for forming a tray, the blank comprising:

a front end panel connected to a front bottom end panel along a bottom edge of the front end panel, the front end panel at least partially removable from the front bottom end panel;

a pair of opposing side panels connected to the front end panel along opposing side edges of the front end panel; and a first bottom side panel connected to a first side panel of the pair of side panels along a bottom edge of the first side panel, wherein the first bottom side panel includes a first plurality of slots for supporting products within the formed tray.

2. The blank of claim 1, further comprising a front top end panel connected to the front end panel along a top edge of the front end panel, wherein the front top end panel is removable with at least a portion of the front end panel.

3. The blank of claim 1, further comprising an access gap extending from the bottom edge of the front end panel into the front bottom end panel, the access gap enabling access to facilitate removal of at least a portion of the front end panel.

4. The blank of claim 1, further comprising a first top side panel connected to the first side panel along a top edge of the first side panel, wherein the first top side panel is removable with at least a portion of the front end panel.

5. The blank of claim 4, further comprising a second top side panel connected to a second side panel of the side panels along a top edge of the second side panel, wherein the second top side panel is removable with at least the portion of the front end panel.

6. The blank of claim 1, further comprising a second bottom side panel connected to a second side panel of the pair of side panels along a bottom edge of the second side panel, the second bottom side panel including a second plurality of slots for supporting the products within the formed tray.

7. The blank of claim 6, wherein the second plurality of slots is configured to substantially align with the first plurality of slots when the tray is formed.

8. The blank of claim 1, further comprising a first perforation line extending through the front end panel from a first of the side edges of the front end panel to a lip defined along the bottom edge of the front end panel, and from the lip to a second of the side edges of the front end panel, the first perforation line enabling removal of a portion of the front end panel.

9. The blank of claim 8, further comprising a second perforation line extending through the first side panel from the first perforation line, the second perforation line enabling removal of a portion of the first side panel.

10. The blank of claim 9, further comprising a third perforation line extending through a second side panel of the pair of side panels from the first perforation line, the third perforation line enabling removal of a portion of the second side panel.

11. A tray formed from a blank, said tray comprising: a front wall connected to, and at least partially removable from, a bottom wall along a bottom edge of the front wall; and a pair of opposing side walls connected to the front wall along opposing side edges of the front wall, wherein the bottom wall comprises a first bottom panel emanating from a first side wall of the pair of side walls along a bottom edge thereof, the first bottom panel comprising a first plurality of slots for supporting products within the tray, wherein the tray further comprises an access gap extending from the bottom edge of the front wall into the bottom wall, the access gap enabling access to facilitate removal of at least a portion of the front wall.

12. The tray of claim 11, further comprising a top wall that is removable from the tray with at least a portion of the front wall.

13. The tray of claim 11, further comprising a back wall emanating from each of the pair of side walls along respective side edges of the pair of side walls, wherein the front wall, the back wall, the bottom wall, and the side walls define a cavity.

14. The tray of claim 11, wherein the bottom wall further comprises a second bottom side panel emanating from a second side wall of the pair of side walls along a bottom edge of the second side wall, the second bottom side panel including a second plurality of slots for supporting the products within the tray.

15. The tray of claim 14, wherein the second plurality of slots is substantially aligned with the first plurality of slots.

16. The tray of claim 11, further comprising a first perforation line extending through the front wall from a first of the side edges of the front wall to a lip defined along a bottom edge of the front wall, and from the lip to a second of the side edges of the front wall, the first perforation line enabling removal of a portion of the front wall from the tray.

17. The tray of claim 16, further comprising: a second perforation line extending through the first side wall from the first perforation line; and a third perforation line extending through a second side wall of the pair of side walls from the first perforation line, wherein the second and third perforation lines cooperate to at least partially enable removal of the top wall from the tray.

18. A method of forming a tray from a blank, the blank including an interior surface, an opposing exterior surface, a front end panel connected to, and at least partially removable from, a front bottom end panel along a bottom edge of the front end panel, a pair of opposing side panels connected to the front end panel along opposing side edges of the front end panel, and a first bottom side panel connected to a first of the side panels along a bottom edge of the first side panel, wherein the first bottom side panel includes a first plurality of slots, said method comprising: rotating the first side panel toward the interior surface of the front end panel, the front end panel defining a front wall of the tray and the first side panel defining a first side wall of the tray; rotating the first bottom side panel toward the interior surface of the first side panel into a substantially perpendicular relationship with the first side panel and the front end panel to at least partially define a bottom wall of the tray, such that the first plurality of slots is configured to support products within the tray; and rotating the front bottom end panel towards the interior surface of the front end panel into a substantially perpendicular relationship with the first side panel and the front end panel to at least partially define the bottom wall, such that at least a portion of the front wall is removable from the tray along a bottom edge of the front wall.

19. The method of claim 18, wherein the blank further includes a second bottom side panel connected to a second of the side panels along a bottom edge of the second side panel, wherein the second bottom side panel includes a second plurality of slots, said method further comprising: rotating the second side panel toward the interior surface of the front end panel, the second side panel defining a second side wall of the tray; and rotating the second bottom side panel toward the interior surface of the second side panel into a substantially perpendicular relationship with the second side panel and the front end panel to at least partially define the bottom wall, such that the second plurality of slots is configured to support the products within the tray.

20. The method of claim 19, wherein said rotating the second bottom side panel comprises substantially aligning the second plurality of slots with the first plurality of slots.

21. The method of claim 18, wherein the blank further includes a back end panel connected to the first side panel along a side edge of the first side panel, and a glue flap connected to a second of the side panels along a side edge of the second side panel, said method further comprising: rotating the second side panel toward the interior surface of the front end panel, the second side panel defining a second side wall of the tray; rotating the back end panel toward the interior surface of the front end panel; and rotating the glue flap toward the interior surface of the second side panel and securing the glue flap to the back end panel, the back end panel and the glue flap defining a back wall of the tray, wherein the front wall, the first side wall, the second side wall, the bottom wall, and the back wall define a cavity of the tray.

22. The method of claim 18, wherein the blank further includes a first perforation line that extends through the front end panel from a first of the side edges of the front end panel to a lip defined along the bottom edge of the front end panel, and from the lip to a second of the side edges of the front end panel, and wherein rotating the front bottom end panel towards the interior surface of the front end panel to at least partially define the bottom wall further comprises rotating the front bottom end panel towards the interior surface of the front end panel such that at least the portion of the front wall is removable from the tray along the first perforation line.

* * * * *